US007611405B2

(12) United States Patent
Wolf et al.

(10) Patent No.: US 7,611,405 B2
(45) Date of Patent: Nov. 3, 2009

(54) DYNAMIC MENU SYSTEM

(75) Inventors: Bryan Wolf, Reno, NV (US); Jamal Benbrahim, Reno, NV (US)

(73) Assignee: IGT, Reno, NV (US)

( * ) Notice: Subject to any disclaimer, the term of this patent is extended or adjusted under 35 U.S.C. 154(b) by 433 days.

(21) Appl. No.: 10/270,766

(22) Filed: Oct. 15, 2002

(65) Prior Publication Data

US 2004/0072611 A1 Apr. 15, 2004

(51) Int. Cl.
*A63F 9/24* (2006.01)

(52) U.S. Cl. ..... 463/20

(58) Field of Classification Search ..... 463/16, 463/17, 18, 19, 20, 25, 29, 40–43; 717/115, 717/139, 120–122; 380/251
See application file for complete search history.

(56) References Cited

U.S. PATENT DOCUMENTS

| | | | | |
|---|---|---|---|---|
| 4,747,127 | A | 5/1988 | Hansen et al. | |
| 4,856,787 | A * | 8/1989 | Itkis | 273/237 |
| 5,041,967 | A * | 8/1991 | Ephrath et al. | 715/825 |
| 5,210,876 | A | 5/1993 | Uchida | |
| 5,404,528 | A | 4/1995 | Mahajan | |
| 5,429,361 | A * | 7/1995 | Raven et al. | 463/25 |
| 5,575,717 | A * | 11/1996 | Houriet et al. | 463/1 |
| 5,675,804 | A | 10/1997 | Sidik et al. | |
| 5,800,269 | A * | 9/1998 | Holch et al. | 463/42 |
| 5,816,918 | A * | 10/1998 | Kelly et al. | 463/16 |
| 5,851,148 | A | 12/1998 | Brune et al. | |
| 5,855,515 | A | 1/1999 | Pease et al. | |
| 5,885,158 | A | 3/1999 | Torango et al. | |
| 5,951,397 | A | 9/1999 | Dickinson | |
| 6,012,984 | A * | 1/2000 | Roseman | 463/42 |
| 6,104,815 | A * | 8/2000 | Alcorn et al. | 380/251 |
| 6,168,520 | B1 | 1/2001 | Baerlocher et al. | |
| 6,210,279 | B1 | 4/2001 | Dickinson | |
| 6,259,446 | B1 * | 7/2001 | Matheny et al. | 715/764 |
| 6,315,664 | B1 | 11/2001 | Baerlocher et al. | |
| 6,315,666 | B1 | 11/2001 | Mastera et al. | |

(Continued)

FOREIGN PATENT DOCUMENTS

| | | |
|---|---|---|
| EP | 0710909 | 5/1996 |

(Continued)

OTHER PUBLICATIONS

Patent Examination/Search report completed by the Great Britain Patent Office for Application No. GB0506717.8 on Jul. 18, 2005.

(Continued)

*Primary Examiner*—Peter DungBa Vo
*Assistant Examiner*—Jasson H Yoo
(74) *Attorney, Agent, or Firm*—Weaver Austin Villeneuve & Sampson LLP

(57) ABSTRACT

A menu system for generating menus including one or more menu items may include an uncompiled text file or script that may be used to specify various characteristics of each menu item. The text file may specify a tree structure in which menu items are to be displayed, the names assigned to the menu items or any security clearance required for viewing or display of the menu items. Additionally, the text file may specify one or more different information or page files associated with each menu item.

31 Claims, 24 Drawing Sheets

U.S. PATENT DOCUMENTS

| | | | | |
|---|---|---|---|---|
| 6,328,649 | B1 | 12/2001 | Randall et al. | |
| 6,368,216 | B1 | 4/2002 | Hedrick et al. | |
| 6,375,187 | B1 | 4/2002 | Baerlocher | |
| 6,409,602 | B1 | 6/2002 | Wiltshire et al. | |
| 6,413,161 | B1 | 7/2002 | Baerlocher et al. | |
| 6,439,995 | B1 | 8/2002 | Hughs-Baird et al. | |
| 6,454,649 | B1 | 9/2002 | Mattice et al. | |
| 6,461,241 | B1 | 10/2002 | Webb et al. | |
| 6,464,582 | B1 | 10/2002 | Baerlocher et al. | |
| 6,471,588 | B2 | 10/2002 | Sakamoto | |
| 6,485,366 | B1 | 11/2002 | Rowe | |
| 6,506,118 | B1 | 1/2003 | Baerlocher et al. | |
| 6,609,974 | B2 | 8/2003 | Mead et al. | |
| 6,666,766 | B2 | 12/2003 | Baerlocher et al. | |
| 7,314,408 | B2 | 1/2008 | Cannon | |
| 2002/0103027 | A1 | 8/2002 | Rowe et al. | |
| 2002/0147047 | A1 | 10/2002 | Letovsky et al. | 463/42 |
| 2002/0151366 | A1 * | 10/2002 | Walker et al. | 463/42 |
| 2003/0064808 | A1 | 4/2003 | Hecht et al. | |

FOREIGN PATENT DOCUMENTS

| | | | |
|---|---|---|---|
| EP | 1113407 | | 7/2001 |
| GB | 2231982 | A * | 11/1990 |
| WO | WO 98/30954 | | 7/1998 |
| WO | WO 01/16842 | | 3/2001 |

OTHER PUBLICATIONS

MenuGadgets Program, Hallogram Publishing (Jan. 12, 2002), retrieved from the Internet (3 pages).

International Search Report from counterpart PCT application (2 pages).

Examination Report from counterpart GB application (1 page).

Ash Matheson, "An Introduction to Lua," GameDev.net, posted Apr. 30, 2003, Retrieved from the Internet on Apr. 20, 2007, http://www.gamedev.net/reference/articles/article1932.asp.

UK Examination Report for Application No. GB0419334.8, dated Dec. 20, 2006.

Australian Government, IP Australia: "Examiner's First Report on Patent Application No. 2004206977:" dated Oct. 25, 2006, 2 pages.

Lerusalimschy et al., "Lua—an extensible extension language", reprinted from Software: Practice & Experience, vol. 26, No. 6, pp. 635-652 (1996), available at http://www.lua.org/spe.html.

Office Action in corresponding application No. GB419334.8 dated Apr. 27, 2006.

Search Report dated Oct. 27, 2004 issued by the Patent Office of Great Britain re Application No. GB0419334.8.

Hal Helms, "Build a simple Mach-II application: consider this when flexibility and maintainability are important goals of your system-foundations," ColdFusion Developer's Journal, Oct. 2003, http://www.findarticles.com/p/articles/mi_m0MLU/is_10_5/ai_109039755.

Nancy Winnick Cluts, "All about Scripting," Microsoft Corporation, Oct. 27, 1997, http://msdn.microsoft.com/library/en-us/dnscrpt/html/allabout.asp?frame=true.

"ECMA Script Language Specification," Dec. 1999, ECMA, available at http://www.bbassett.net/njs/e262-3.pdf.

UK Examination Report for Application No. GB0419334.8 dated Dec. 13, 2007, 3 pages.

Australian Government, IP Australia: "Examiner's 2nd Report on Patent Application No. 2004206977:" dated Feb. 13, 2008, 2 pages.

Notice of Allowance dated Sep. 30, 2008 in U.S. Appl. No. 10/659,821.

Allowed Claims, U.S. Appl. No. 10/659,821, Notice of Allowance made Sep. 30, 2008. Claims amended on Oct. 24, 2008.

Anon, "MenuGadgets program," Hallogram Publishing, (Jan. 2002); accessed on web at http://web.archive.org/web/20020112004707/http://hallogram.com/menugadgets on May 3, 2004.

International Search Report issued for PCT/US03/31750 on Mar. 8, 2004.

* cited by examiner

FIG. 10
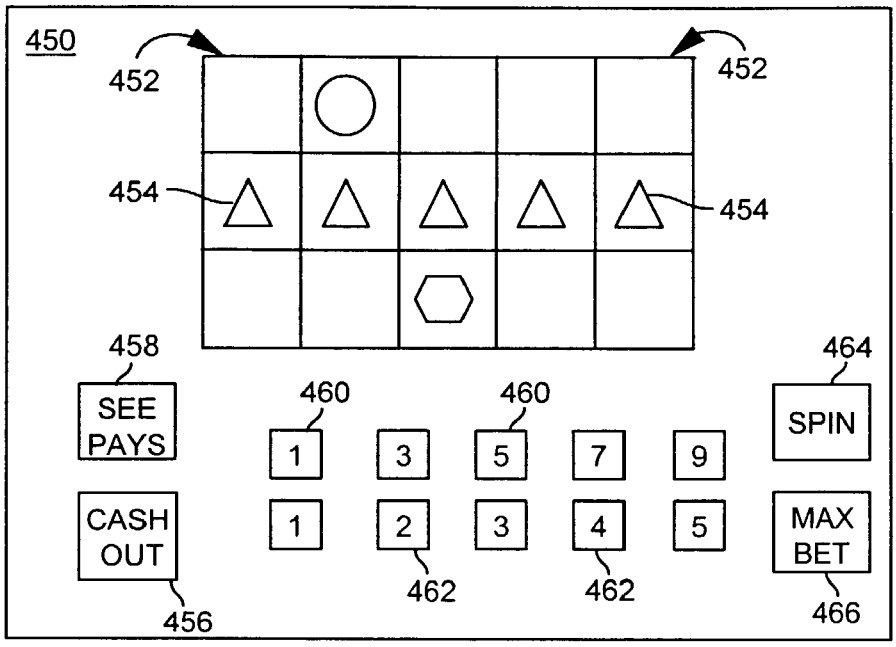
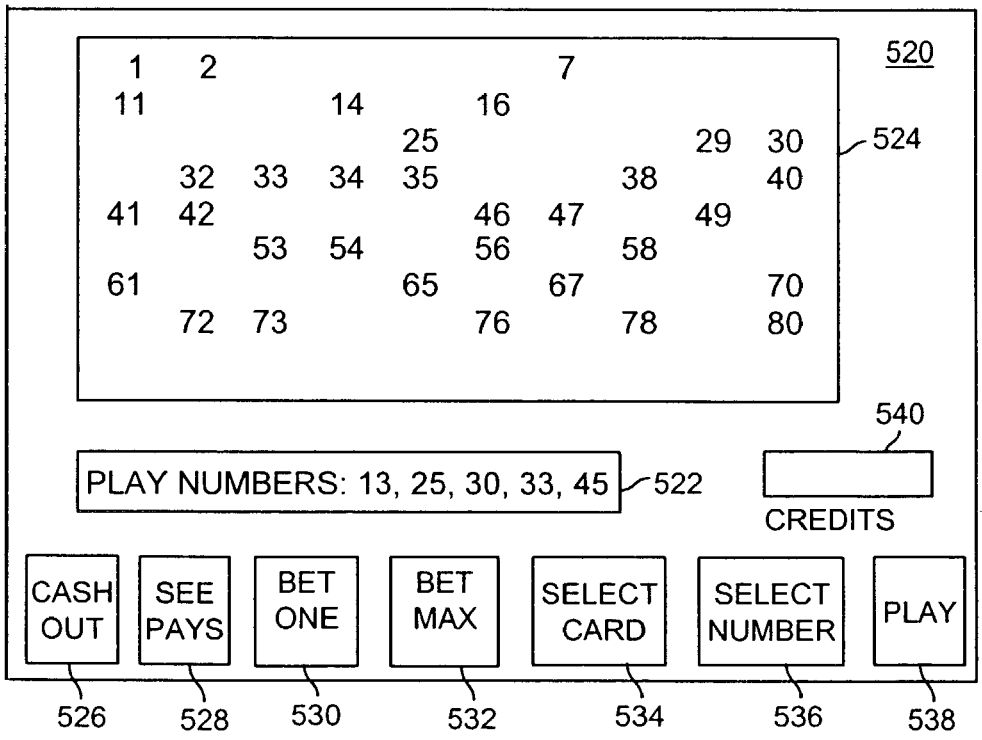
FIG. 11

```
722                                720
Menu
{
                728
  Items ()
  {
                734                 736          738   740  742   744      724
732A  Item ("MainAccounting", "Accounting", enabled, "", "", ATTENDANT) {}
732B  Item ("MainDiagnostics", "Diagnostics", enabled, "", "", ATTENDANT) {}
732C  Item ("MainEventLogs", "Event Logs", enabled, "", "", ATTENDANT) {}
732D  Item ("MainSetup", "Setup", enabled, "", "", ATTENDANT) {}
732E  Item ("MainInstallation", "Install", disabled, "", "", OPERATOR) {}

732F  Item ("GameSetup", "Game Options", enabled, "", "GamePage.so",
          OPERATOR) {}

732G  Item ("CommSetup", "Comm Config", enabled, "CommConfigPage.so",
          ConfigPage.so", OPERATOR) {}
732H  Item ("MachineSetup", "Machine Options", enabled, "", "",
          ATTENDANT) {}
732I  Item ("AttractSetup", "Attract Setup", enabled, "", "AttractPage.so",
          ATTENDANT) {}
732J  Item ("ClockSetup", "Clock Setup", enabled, "", "ClockPage.so",
          OPERATOR) {}
732K  Item ("SiteIDSetup", "Site ID Setup", enabled, "", "SiteIDPage.so",
          OPERATOR) {}
732L  Item ("VolumeSetup", "Volume", enabled, "", "VolumePage.so",
          OPERATOR) {}                                          778
```

FIG. 17A

```
        Item ("ReelStripTest", "ReelStripTests", enabled, "info.so", "",
732M          ATTENDANT) {}
      }
                                                                  762
      Links
      {       730
        RootMenu
750     {
          add ("MainAccounting");                                 726
752A      add ("MainDiagnostics");
752B      add ("MainEventLogs");
752C      add ("MainSetup");
752D

        Submenu ("MainSetup")
754     {
          add ("GameSetup");
756A      add ("CommSetup");
756B      add ("MachineSetup");
756C

        Submenu ("MachineSetup")
758     {
          add ("AttractSetup");
760A      add ("ClockSetup");
760B      add ("SiteIDSetup");
760C      add ("VolumeSetup")
760D
        Submenu ("MainDiagnostics")
762     {
          add ("ReelstripTest");
        }
      }
    }
```

FIG. 17B

770

INFO.SO

```
{ IF GameType!=Slots
then "disable."
}
```

FIG. 18

780

VOLUMEPAGE.SO

```
{ load volume page
}
```

FIG. 19

DYNAMIC MENU SYSTEM

BACKGROUND

Traditionally, gambling games, like slot machines, were mechanical in nature and included arrangements of levers, gears, springs and the like that would be set into motion when a player pulled, for example, a slot machine level arm. While such gambling games were entertaining, all gambling games had essentially the same configuration, thereby not providing players with a variety of gaming configurations.

The advent of the electronic gambling game based on a processing unit, such as a microprocessor, enabled gambling games to have longer lifespans because there were fewer mechanical parts to wear out. Additionally, the variety of gambling games increased because the processing units could be programmed in various manners to provide a selection of gambling games. For example, while mechanical gambling games were typically configured as slot machines, electronic gambling games could be configured as slot machines, poker games, keno games, bingo games or any other suitable styles of gambling games that software and game designers could envision. Today, nearly all gambling games are electronic and are based on processing units.

Gaming boards oversee the regulation of the gambling industry by breaking a geographic area into a number of jurisdictions. Most any machine implementing a gambling game in a particular jurisdiction must be inspected, approved and certified by a gaming board of that jurisdiction before the machine may be placed in service within a casino in that jurisdiction. The certification process may be a long process that increases the development cycle time of gambling game innovation.

As will be readily appreciated, the requirements for gambling games vary between jurisdictions. For example, a gaming machine may include a number of menus that may be used by service personnel and the type and contents of such menus may be regulated by the gaming boards. The gaming boards of various jurisdictions may impose different menu requirements, which results in a number of different software instruction sets providing menu systems.

Because each gambling game must be inspected and approved by a gaming board, any software changes within the gambling game necessitate recertification of the game. Accordingly, because menuing software, among other things, changes between jurisdictions, each machine having different menu software would have to be recertified. Additionally, menu changes within a jurisdiction also necessitate recertification.

SUMMARY OF THE INVENTION

According to one, aspect, the present invention may be embodied in a gaming apparatus including a display unit that is capable of generating video images, a value input device and a controller operatively coupled to the display unit and the value input device, the controller may include a processor and a memory operatively coupled to the processor. The controller may be programmed to allow a person to make a wager, to cause a video image representing a game to be generated on the display unit, the video image representing one of the following games: video poker, video blackjack, video slots, video keno or video bingo. In such an arrangement, the video image may include an image of at least five playing cards if the game is video poker, the video image may include an image of a plurality of simulated slot machine reels if the game is video slots, and the video image may be an image of a plurality of playing cards if the game is video blackjack. Additionally, the video image may be an image of a plurality of keno numbers if the game is video keno and the video image may be an image of a bingo grid if the game is video bingo. The controller may further be programmed to determine a value payout associated with an outcome of the game and to cause a video image representing a menu that may include a menu item to be displayed on the display unit by accessing an uncompiled menu script specifying characteristics of the menu item.

According to another aspect, a gaming apparatus may include a display unit that is capable of generating video images, a value input device and a controller operatively coupled to the display unit and the value input device. In such an arrangement, the controller may include a processor and a memory operatively coupled to the processor. In such an arrangement, the controller may be programmed to allow a person to make a wager, to cause a video image to be generated on the display unit, wherein the video image may represent a game. The controller may also be programmed to determine, after the video image has been displayed, a value payout associated with an outcome of the game represented by the video image. Further, the controller may be programmed to cause a video image of a menu, which may include a menu item, to be generated on the display unit by accessing an uncompiled file specifying characteristics of the menu item.

According to a third aspect, the a gaming apparatus may include a display unit that is capable of generating video images, a value input device and a controller operatively coupled to the display unit and the value input device, the controller may include a processor and a memory operatively coupled to the processor, the memory may include a text file specifying characteristics of a menu item. The controller may be programmed to read the text file and to cause a video image of the menu item to be generated on the display unit, wherein the menu item may include characteristics specified in the text file. The controller may also be programmed to cause a video image of a game to be generated on the display unit and may further be programmed to determine a value payout associated with an outcome of the game.

According to a further aspect, a gaming method may include causing a video image representing a game to be generated, the video image representing one of the following games: video poker, video blackjack, video slots, video keno or video bingo. The video image may depend on the game and may be an image of at least five playing cards, a plurality of simulated slot machine reels, an image of a plurality of playing cards, an image of a plurality of keno numbers or an image of a bingo grid. The method may also include determining a value payout associated with an outcome of the game represented by the video image, determining that a menu item is to be generated and accessing an uncompiled file that specifies characteristics of the menu item that is to be generated. Furthermore, the method may include reading from the uncompiled file the characteristics of the menu item that is to be generated and generating a menu display including the menu item, wherein the menu item comprises characteristics defined by the uncompiled file.

The present invention may also be embodied in a memory having a computer program stored therein, wherein the computer program is capable of being used in connection with a gaming apparatus. The memory may include a number of memory portions physically configured in accordance with computer program instructions that would cause the gaming apparatus to perform various tasks. For example, the memory may be programmed to cause the gaming apparatus to allow a person to make a wager, to cause a video image representing a game to be generated on a display unit, the video image representing one of the following games: video poker, video blackjack, video slots, video keno or video bingo and to determine a value payout associated with an outcome of the game represented by the video image. The memory may also include portions that would cause the gaming apparatus to determine that a menu item is to be generated, to store information representative of characteristics of the menu item to be generated, wherein information stored in the memory portion is uncompiled and to access the fifth memory portion. The memory may also include portions that would cause the gaming apparatus to read from the memory portion the characteristics of the menu item that is to be generated and to generate a menu display including the menu item, wherein the menu item comprises characteristics defined by the memory portion.

Additional aspects of the invention are defined by the claims of this patent.

BRIEF DESCRIPTION OF THE DRAWINGS

FIG. 10 is an illustration of an embodiment of a visual display that may be displayed during performance of the slots routine of FIG. 12;

FIG. 11 is an illustration of an embodiment of a visual display that may be displayed during performance of the video keno routine of FIG. 13;

FIG. 17 is an example menu script;

FIG. 18 is an example information object;

FIG. 19 is an example page object;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
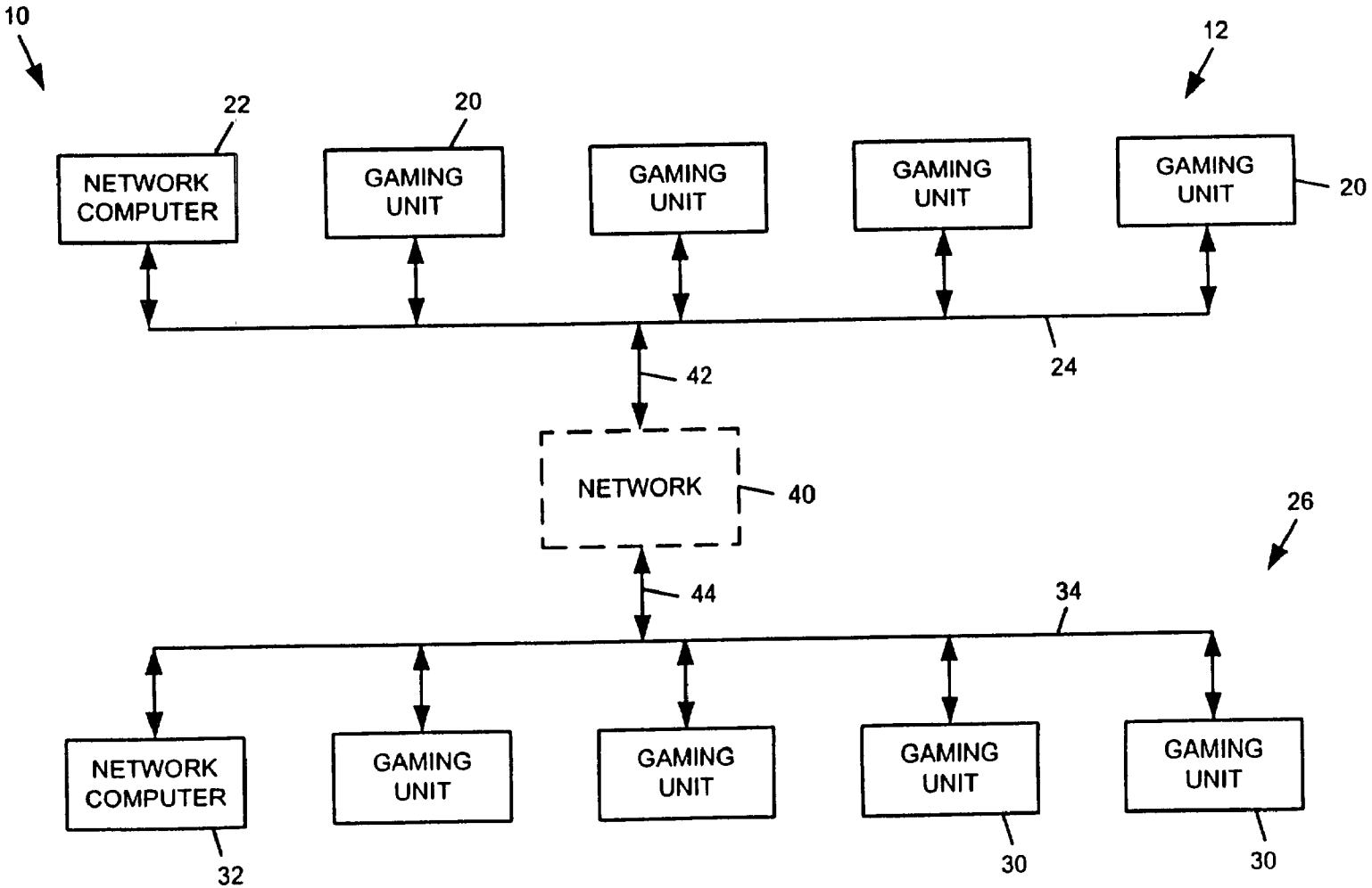
FIG. 1 is a block diagram of an embodiment of a gaming system in accordance with the invention.

FIG. 1 illustrates one possible embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
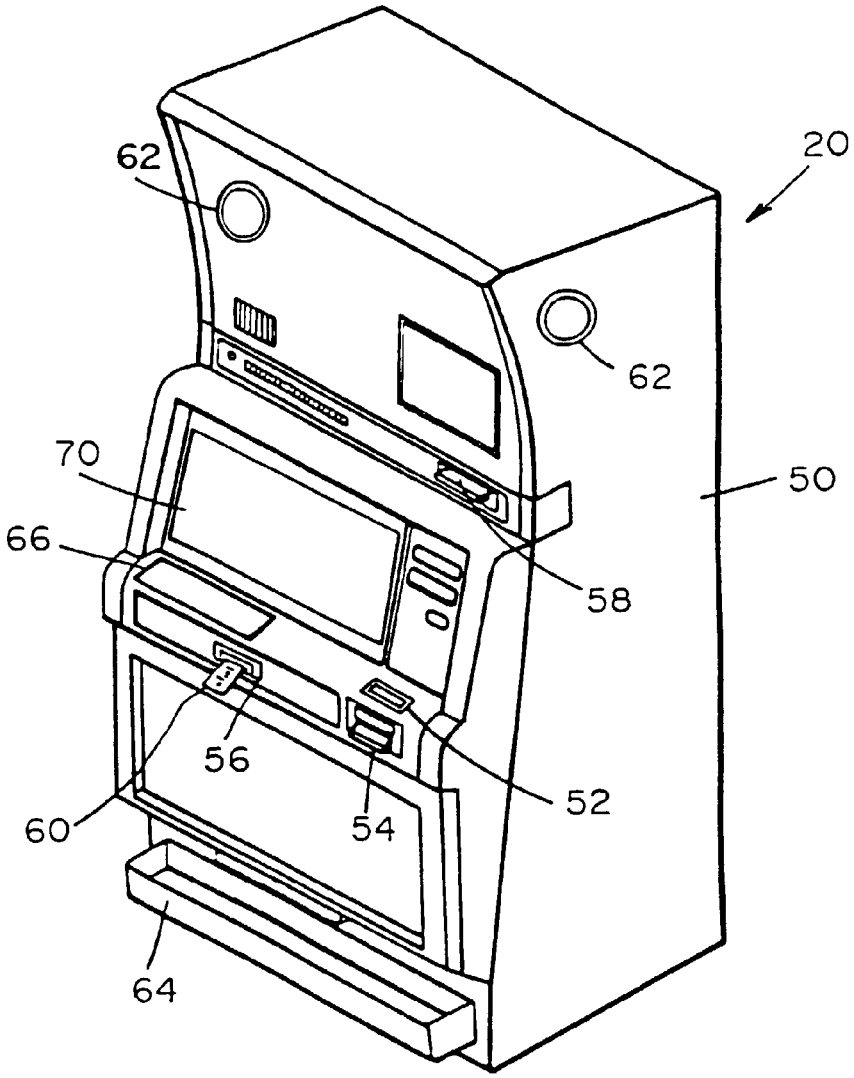
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, smart cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

Figure 2A:
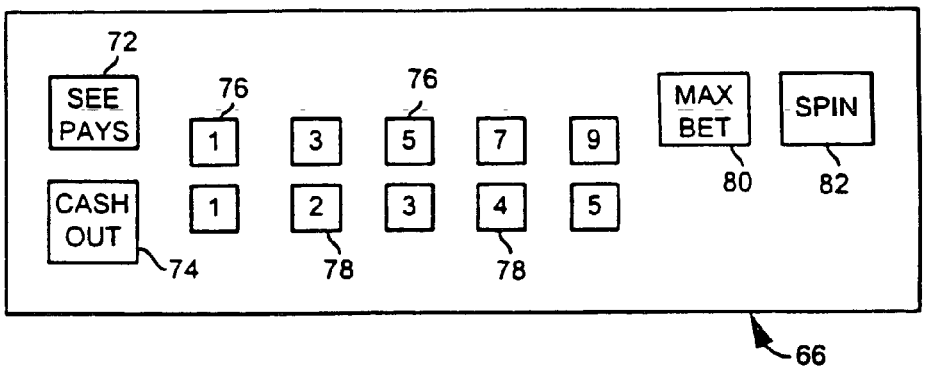
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device-that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3:
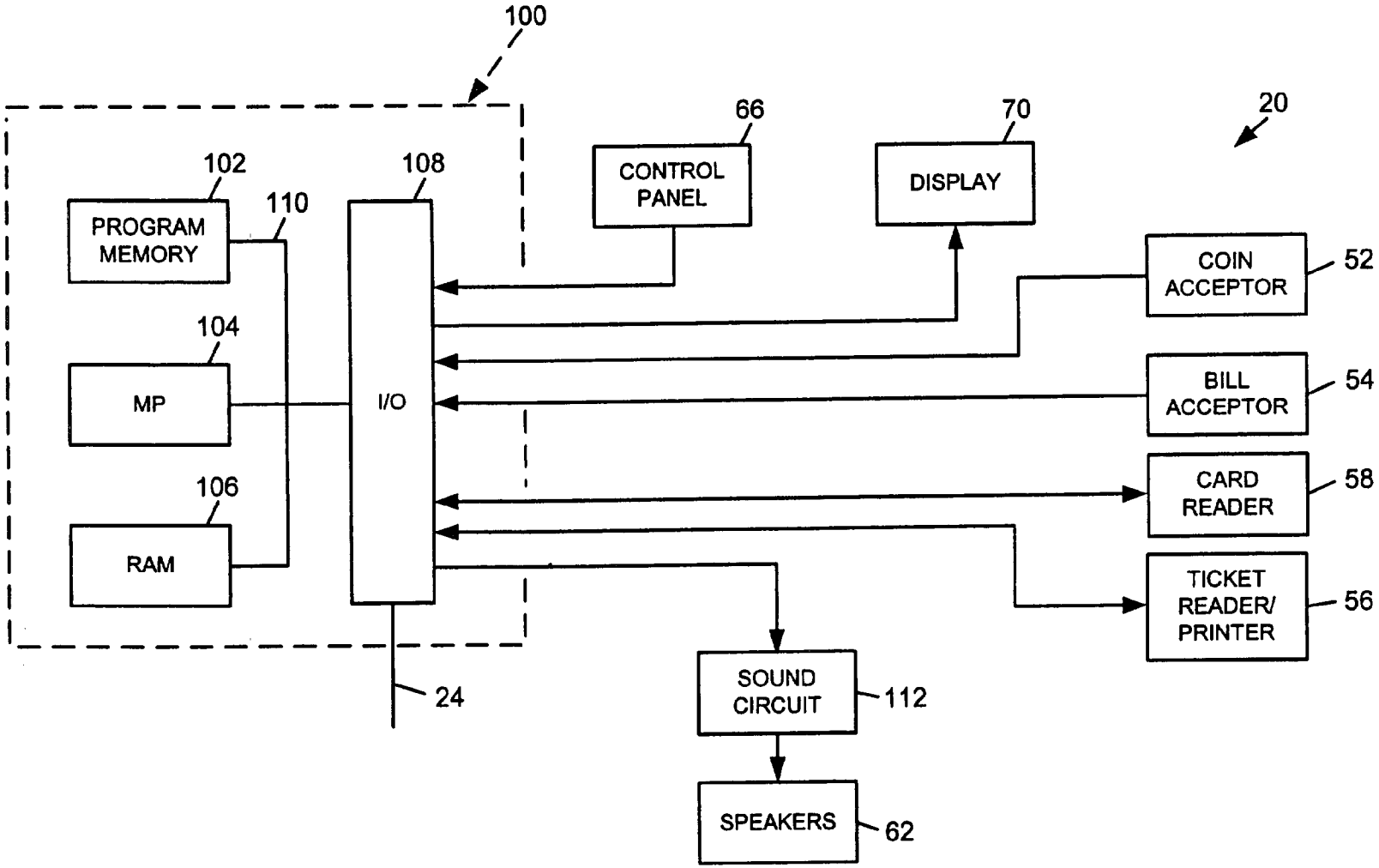
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

Although the program memory 102 is shown in FIG. 3 as a read-only memory (ROM) 102, the program memory of the controller 100 may be a read/write or alterable memory, such as a hard disk. In the event a hard disk is used as a program memory, the address/data bus 110 shown schematically in FIG. 3 may comprise multiple address/data buses, which may be of different types, and there may be an I/O circuit disposed between the address/data buses.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice-and sound-synthesis circuit or that may comprise a driver circuit. The sound-generating circuit 112 may be coupled to the I/O circuit 108.

As shown in FIG. 3, the components 52, 54, 56, 58, 66, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C++, C#, Java or the like or any low-level assembly or machine language. By storing the computer program portions therein, various portions of the memories 102, 106 are physically and/or structurally configured in accordance with computer program instructions.

Figure 4:
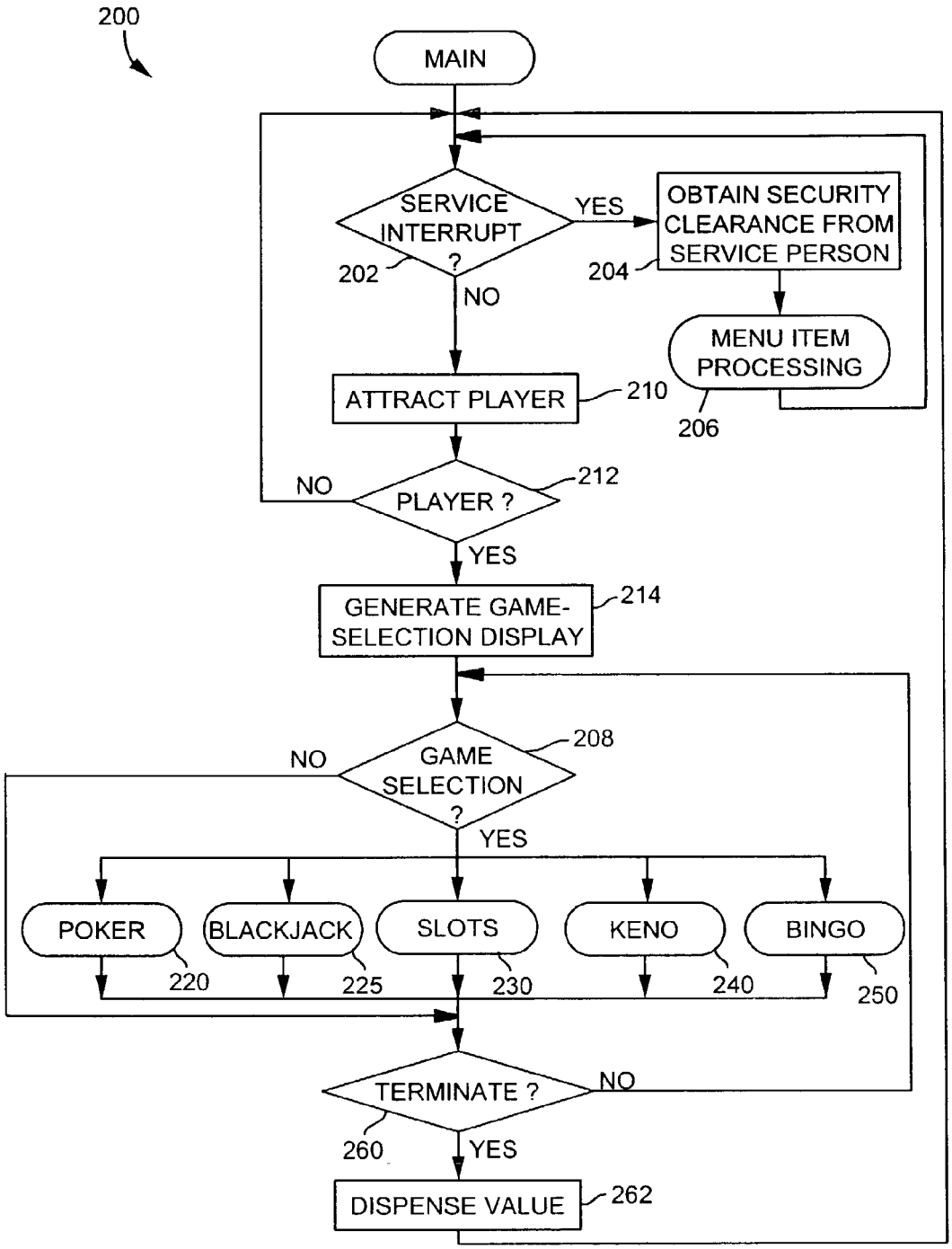
FIG. 4 is a flowchart of an embodiment of a main routine that may be performed during operation of one or more of the gaming units.

FIG. 4 is a flowchart of a main operating routine 200 that may be stored in the memory of the controller 100. Referring to FIG. 4, the main routine 200 may begin operation at block 202 during which the controller 100 determines whether a service interrupt has been received. Service interrupts may be triggered by casino maintenance personnel or any other suitable person opening the cabinet 50. If a service interrupt has been received, the controller 100 obtains security clearance information from the person who generated the service interrupt detected (block 204). The security clearance may be determined by, for example, maintenance personnel entering a security code, depressing buttons of the control panel 66 in a particular sequence or by swiping an identification card bearing a magnetic strip through a card reader that is coupled to the gaming unit 20.

Figure 20:
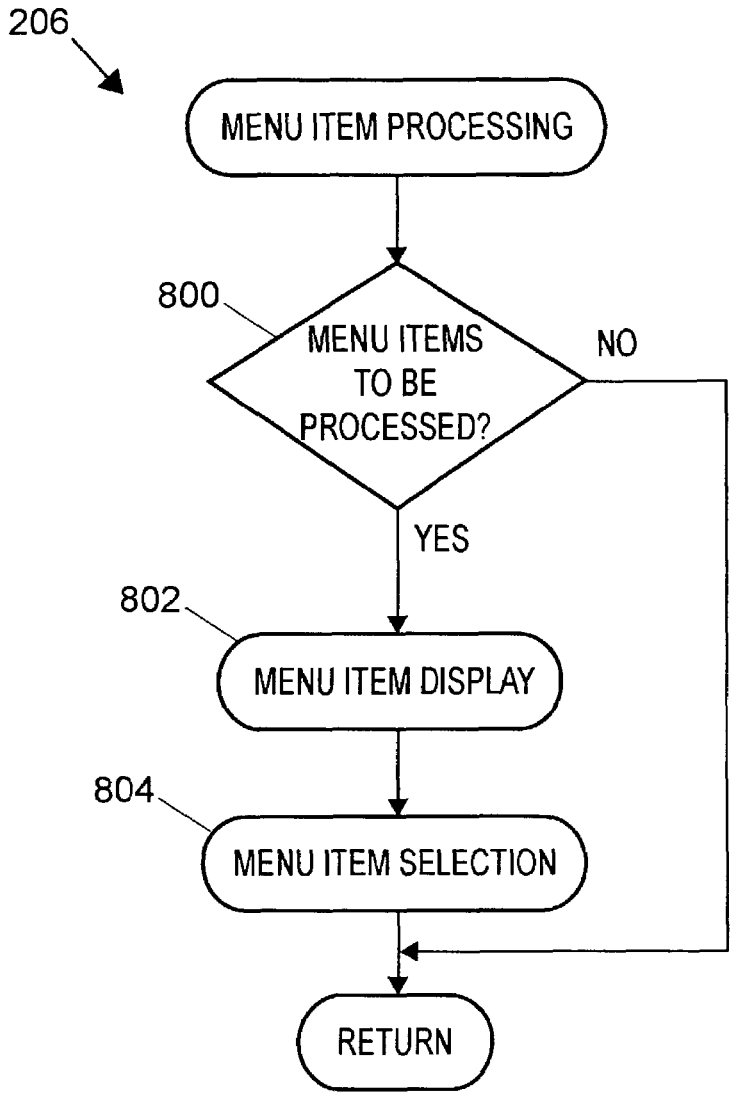
FIG. 20 is a flowchart of an embodiment of the menu item processing routine of FIGS. 4 and 5.

After the security clearance of the maintenance personnel has been obtained at block 204, a menu item processing routine 206, the details of which are described below in conjunction with FIG. 20, is executed by the controller 100. In general; the menu item processing routine 206 controls the information and menu items that will be displayed to maintenance personnel on the display 70 of the gaming unit 20.

Although the determination of a service interrupt 202 is shown at the beginning of the main routine 200, those having ordinary skill in the art will readily recognize that the functionality of blocks 202-206 could be located at any suitable place within the routine 200. Additionally or alternatively, the detection of a service interrupt could be based on an interrupt provided to the controller 100 that causes the controller 100 to halt code execution and to run an interrupt service routine that includes the functionality of blocks 202-206.

After either the controller 100 determines that a service interrupt has not been received (block 202) the controller 100 attempts to attract a player at block 210 at which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 212, the attraction sequence may be terminated and a game-selection display may be generated on the display unit 70 at block 214 to allow the player to select a game available on the gaming unit 20. The gaming unit 20 may detect an input at block 212 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 214 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 220, a video blackjack routine 225, a slots routine 230, a video keno routine 240, and a video bingo routine 250.

After one of the routines 220, 225, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

At block 208, if no game selection is made within a given period of time, the operation may branch to block 260.

It should be noted that although five gaming routines are shown in FIG. 4, a different number of routines could be included to allow play of a different number of games. The gaming unit 20 may also be programmed to allow play of different games.

Figure 5:
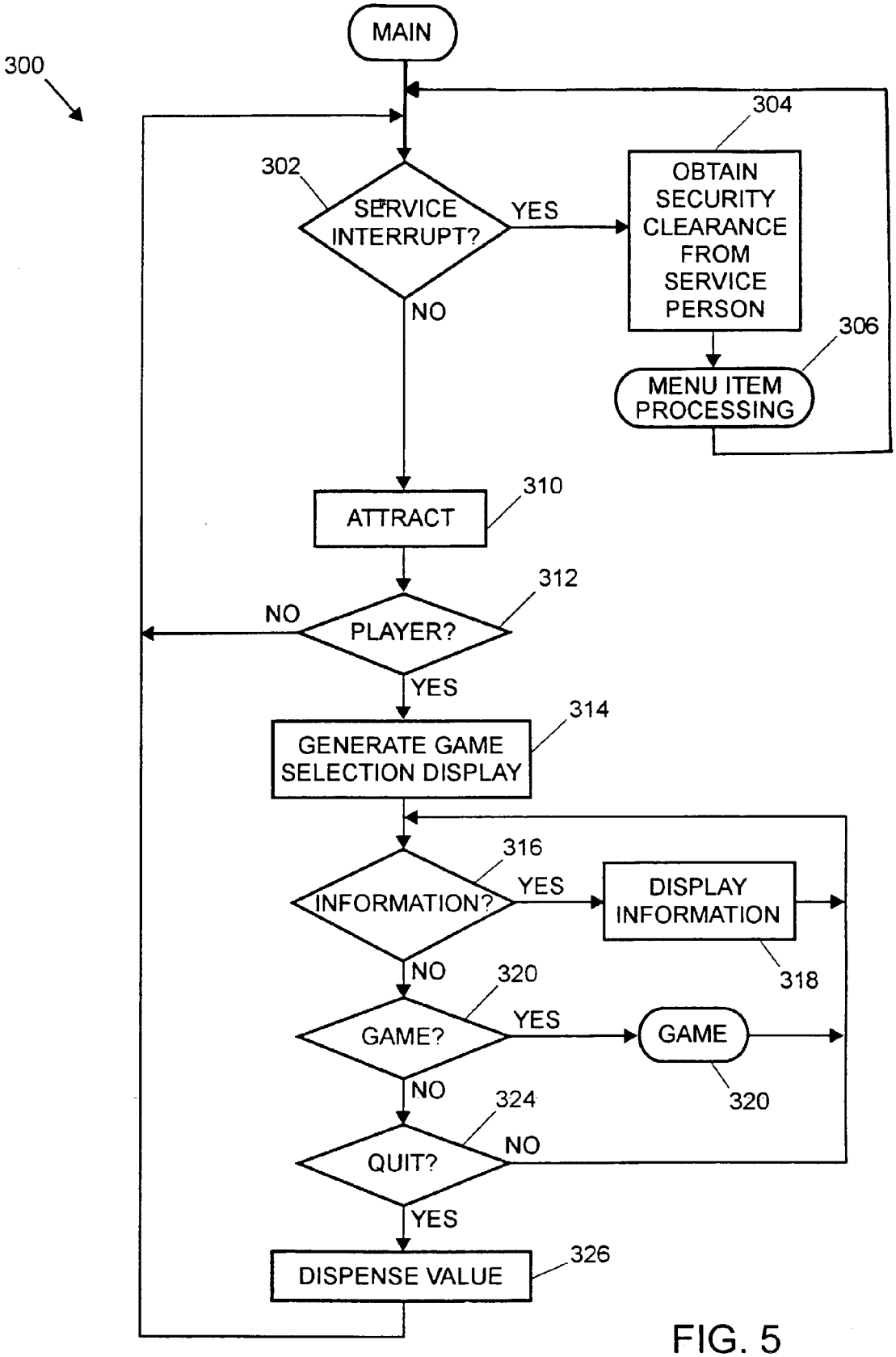
FIG. 5 is a flowchart of an alternative embodiment of a main routine that may be performed during operation of one or more of the gaming units.

FIG. 5 is a flowchart of an alternative main operating routine 300 that may be stored in the memory of the controller 100. The main routine 300 may be utilized for gaming units 20 that are designed to allow play of only a single game or single type of game. Referring to FIG. 5, the main routine 300 may begin operation at block 302 at which the controller 100 determines if a service interrupt has been received. If a service interrupt has been received, the controller 100 executes block 304, which operates in a similar manner to the block 204 described in conjunction with FIG. 4. After obtaining the security clearance from the service person who generated the service interrupt, the controller 100 executes a menu item processing routine 306, which may be identical to the menu item processing routine 206 of FIG. 4, but has been assigned a different reference numeral for clarity. The details of the menu item processing routines (both block 206 and 306) are provided hereinafter in connection with FIG. 20.

If a service interrupt is not detected (block 302) the controller 100 executes block 310 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 312, the attraction sequence may be terminated and a game display may be generated on the display unit 70 at block 314. The game display generated at block 314 may include, for example, an image of the casino game that may be played on the gaming unit 20 and/or a visual message to prompt the player to deposit value into the gaming unit 20. At block 316, the gaming unit 20 may determine if the player requested information concerning the game, in which case the requested information may be displayed at block 318. Block 320 may be used to determine if the player requested initiation of a game, in which case a game routine 322 may be performed. The game routine 322 could be any one of the game routines disclosed herein, such as one of the five game routines 220, 225, 230, 240, 250, or another game routine.

After the routine 322 has been performed to allow the player to play the game, block 324 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 326 based on the outcome of the game(s) played by the player. The operation may then return to block 302. If the player did not wish to quit as determined at block 324, the operation may return to block 316.

Video Poker

Figure 6:
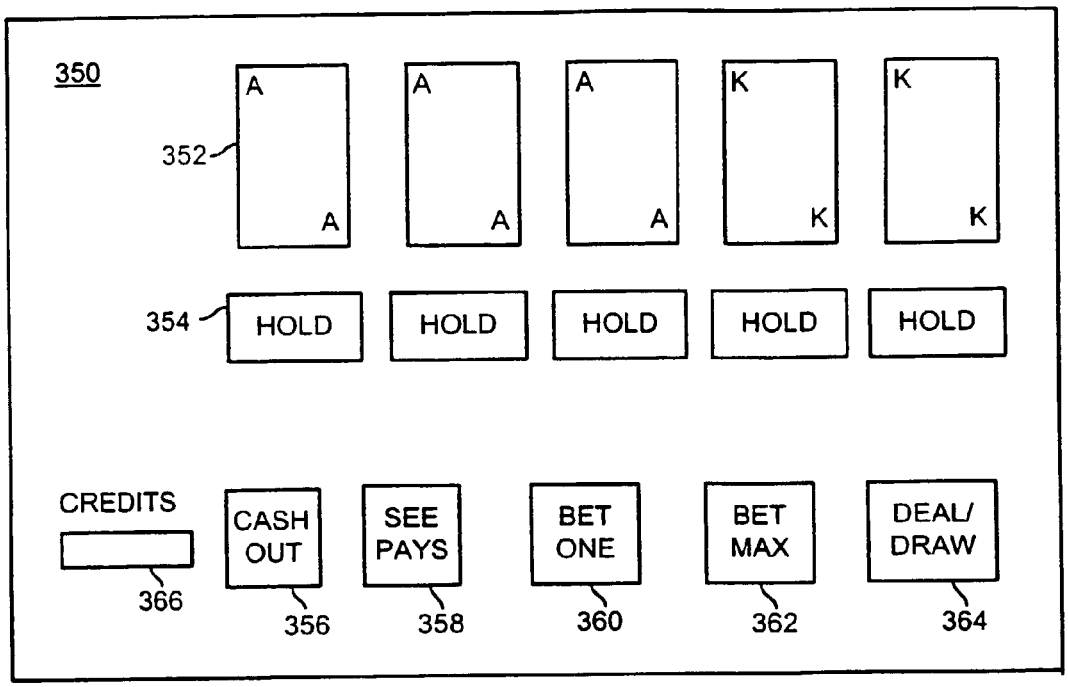
FIG. 6 is an illustration of an embodiment of a visual display that may be displayed during performance of the video poker routine of FIG. 8.

FIG. 6 is an exemplary display 350 that may be shown on the display unit 70 during performance of the video poker routine 220 shown schematically in FIG. 4. Referring to FIG. 6, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 8:
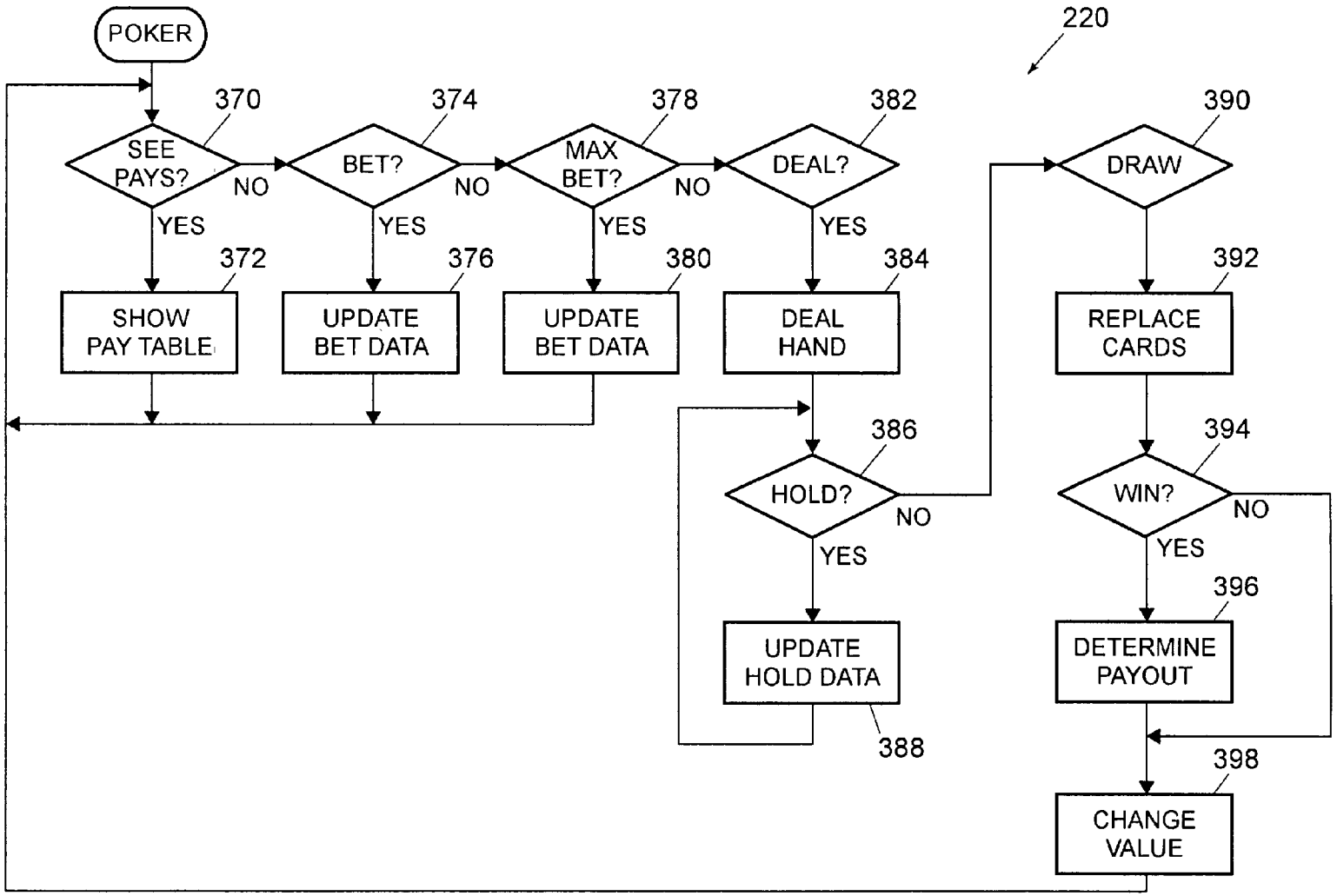
FIG. 8 is a flowchart of an embodiment of a video poker routine that may be performed by one or more of the gaming units.

FIG. 8 is a flowchart of the video poker routine 220 shown schematically in FIG. 4. Referring to FIG. 8, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 6).

Although the video poker routine 220 is described above in connection with a single poker hand of five cards, the routine 220 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 7:
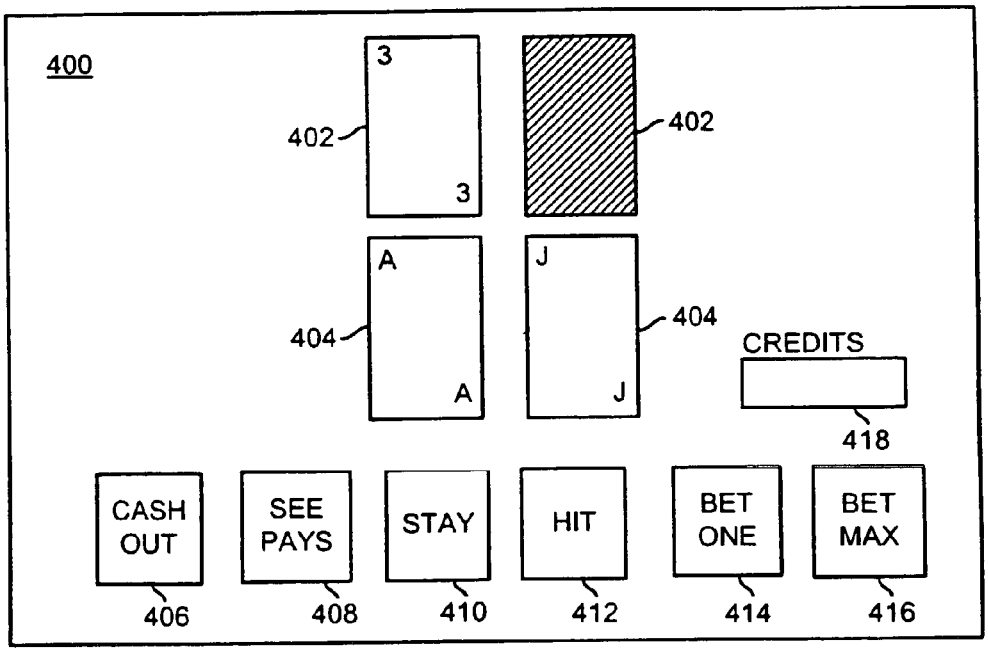
FIG. 7 is an illustration of an embodiment of a visual display that may be displayed during performance of the video blackjack routine of FIG. 9.

FIG. 7 is an exemplary display 400 that may be shown on the display unit 70 during performance of the video blackjack routine 225 shown schematically in FIG. 4. Referring to FIG. 7, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 9:
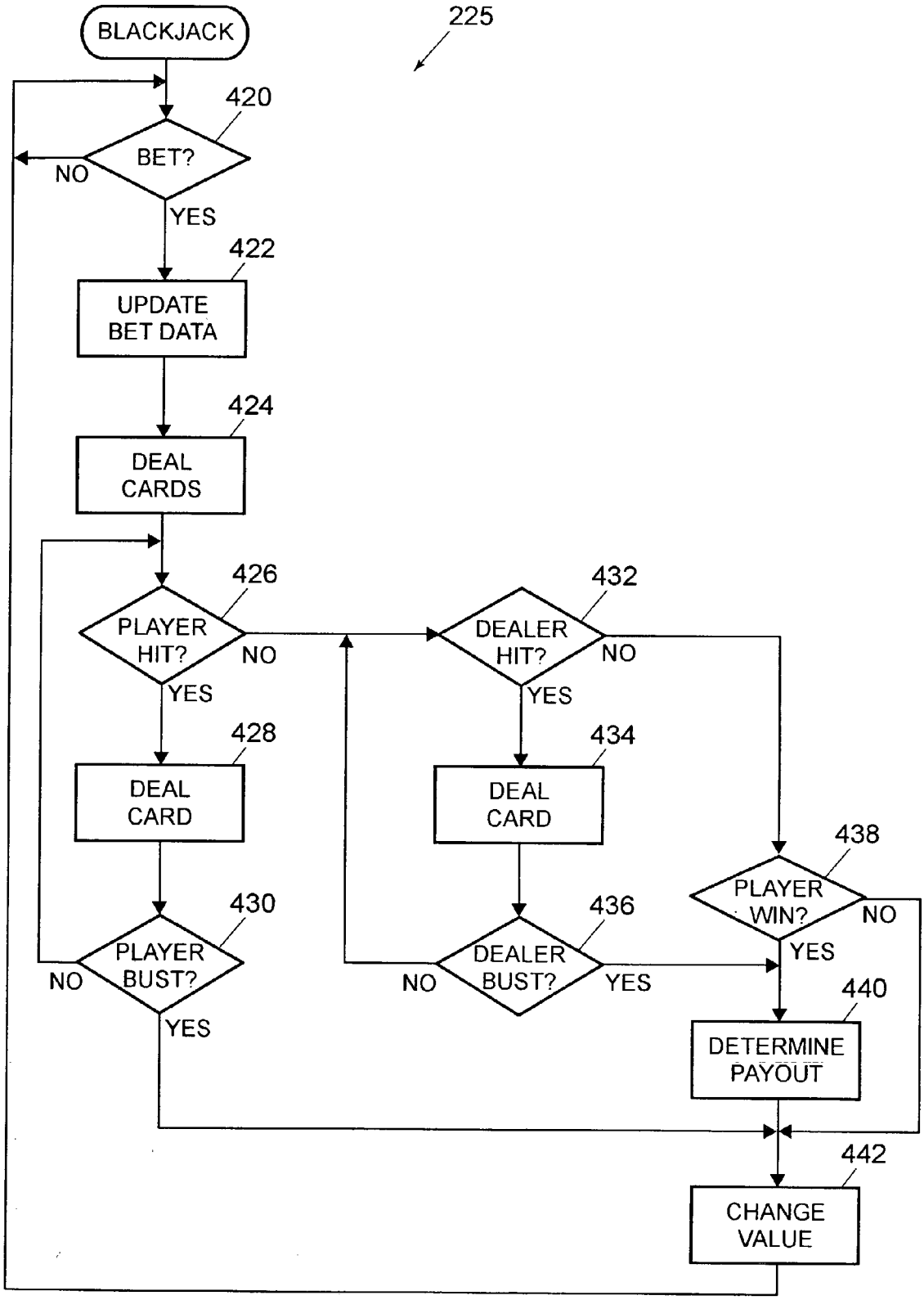
FIG. 9 is a flowchart of an embodiment of a video blackjack routine that may be performed by one or more of the gaming units.

FIG. 9 is a flowchart of the video blackjack routine 225 shown schematically in FIG. 4. Referring to FIG. 9, the video blackjack routine 225 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440.

The cumulative value or number of credits may also be displayed in the display area 418 (FIG. 7).

Slots

FIG. 10 is an exemplary display 450 that may be shown on the display unit 70 during performance of the slots routine 230 shown schematically in FIG. 4. Referring to FIG. 10, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 12:
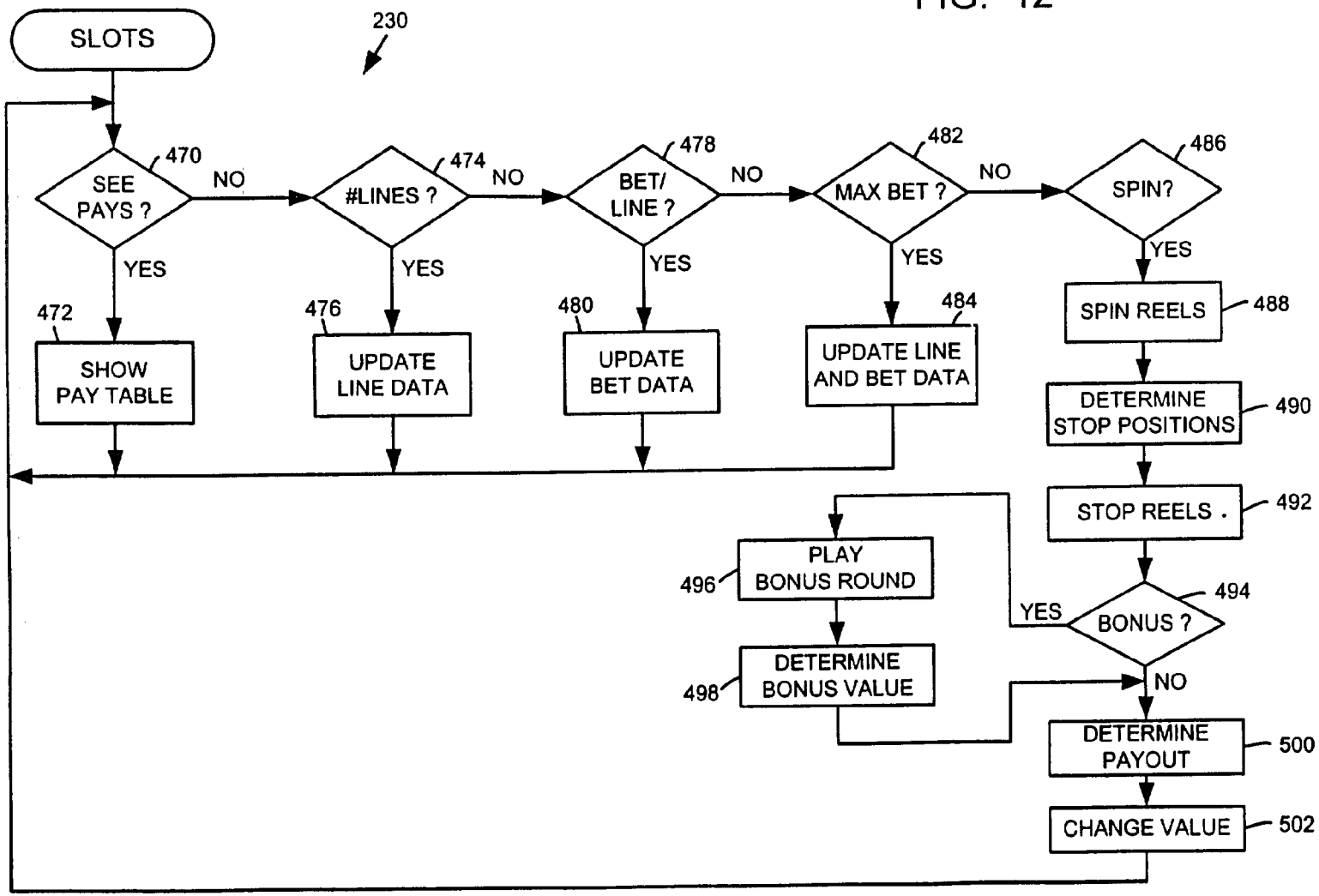
FIG. 12 is a flowchart of an embodiment of a slots routine that may be performed by one or more of the gaming units.

FIG. 12 is a flowchart of the slots routine 230 shown schematically in FIG. 10. Referring to FIG. 12, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 11 is an exemplary display 520 that may be shown on the display unit 70 during performance of the video keno routine 240 shown schematically in FIG. 4. Referring to FIG. 11, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 13:
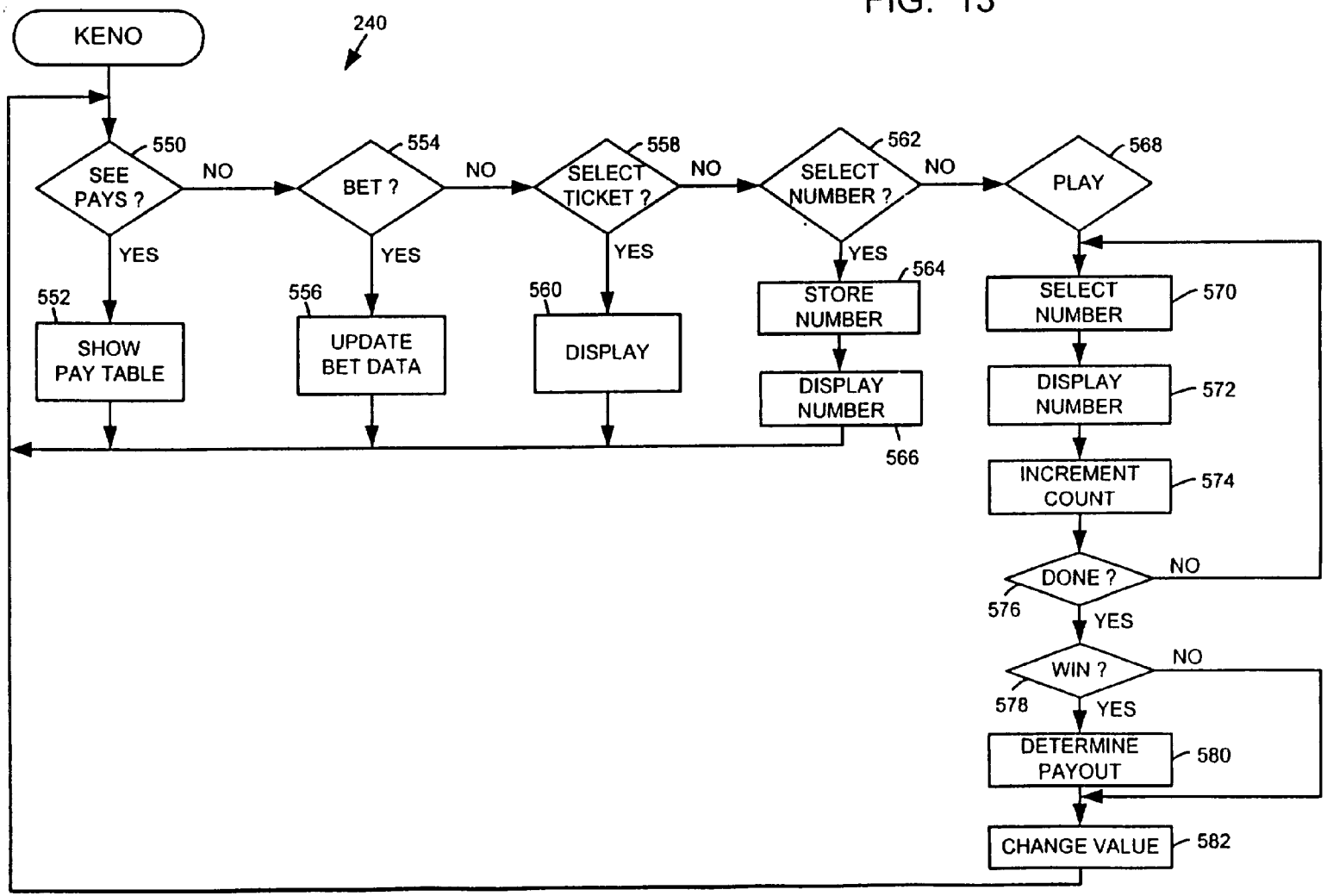
FIG. 13 is a flowchart of an embodiment of a video keno routine that may be performed by one or more of the gaming units.

FIG. 13 is a flowchart of the video keno routine 240 shown schematically in FIG. 4. The keno routine 240 may be utilized in connection with a single gaining unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 13, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 11).

Video Bingo

Figure 14:
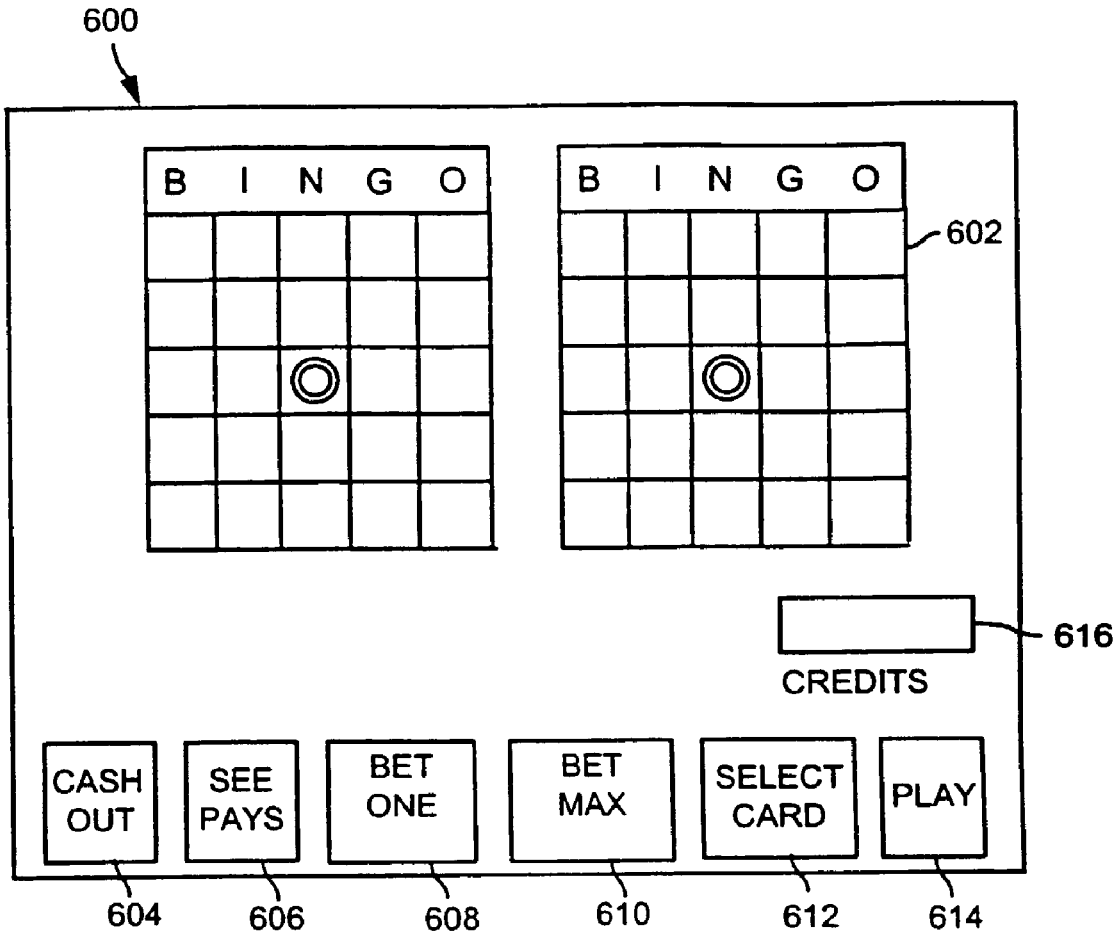
FIG. 14 is an illustration of an embodiment of a visual display that may be displayed during performance of the video bingo routine of FIG. 15.

FIG. 14 is an exemplary display 600 that may be shown on the display unit 70 during performance of the video bingo routine 250 shown schematically in FIG. 4. Referring to FIG. 14, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively one or more of those buttons may be provided as part of a control panel that is provided separately from the display unit 70.

Figure 15:
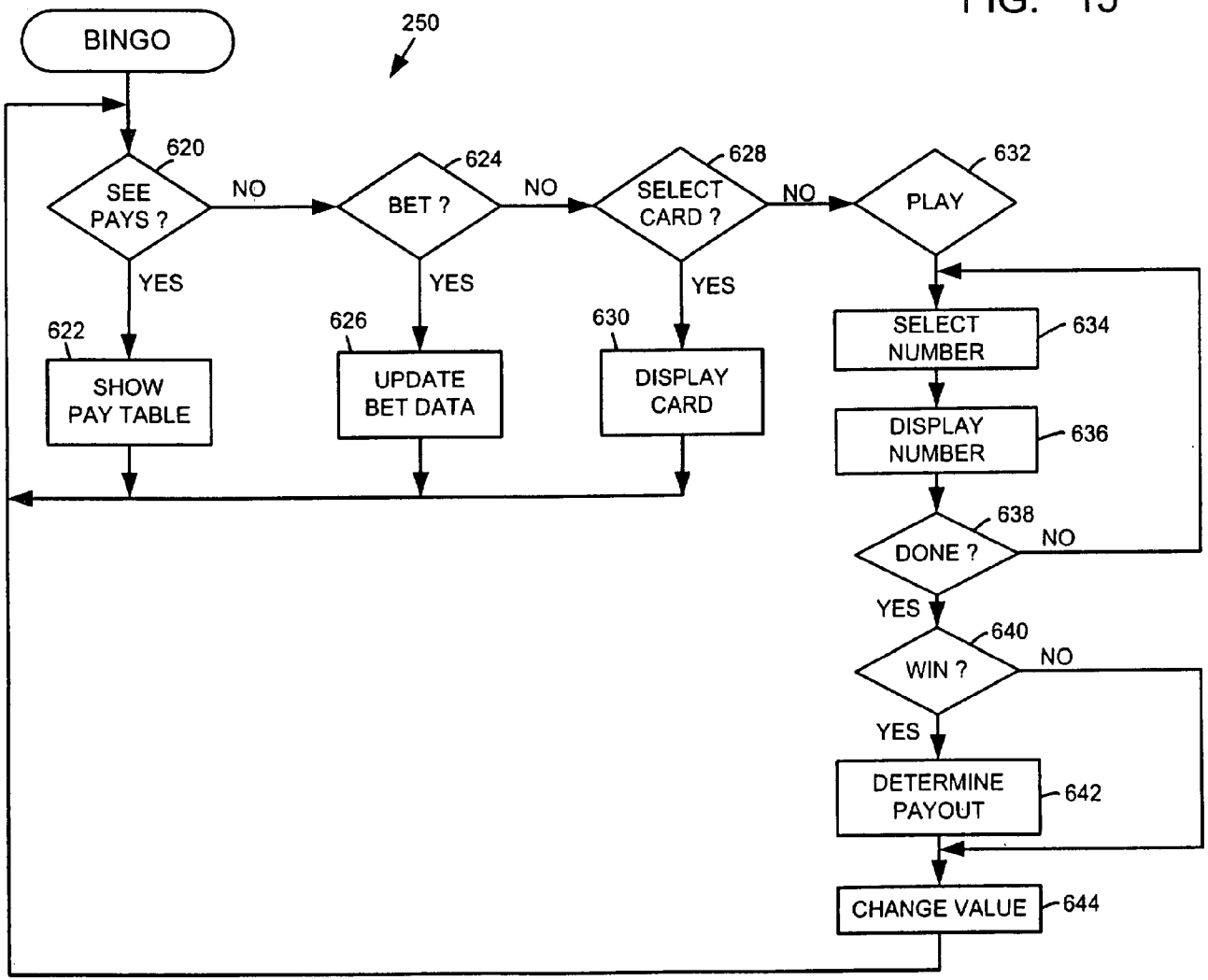
FIG. 15 is a flowchart of an embodiment of a video bingo routine that may be performed by one or more of the gaming units.

FIG. 15 is a flowchart of the video bingo routine 250 shown schematically in FIG. 4. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 15, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 14).

Menu System

One implementation of a menu system will now be described in conjunction with FIGS. 16-27. In general, as described below, the menu system may include software that is compiled into machine language and software embodied text-based files that are uncompiled. This partially-compiled system enables a programmer or software engineer to make updates and changes to the menu system without having to rewrite and recompile software simply by changing the content of the text-based files. The text-based files may merely be uncompiled text or could be embodied in text scripts and the like. While changing compiled software, within the gaming unit 20 likely necessitates recertification of the gaming unit 20, modifications to the uncompiled text-based script do not likely require recertification. Accordingly, if changes to the menuing or any other system can be accomplished through modification to the text-based script, time consuming recertification processes may be avoided.

Figure 16:
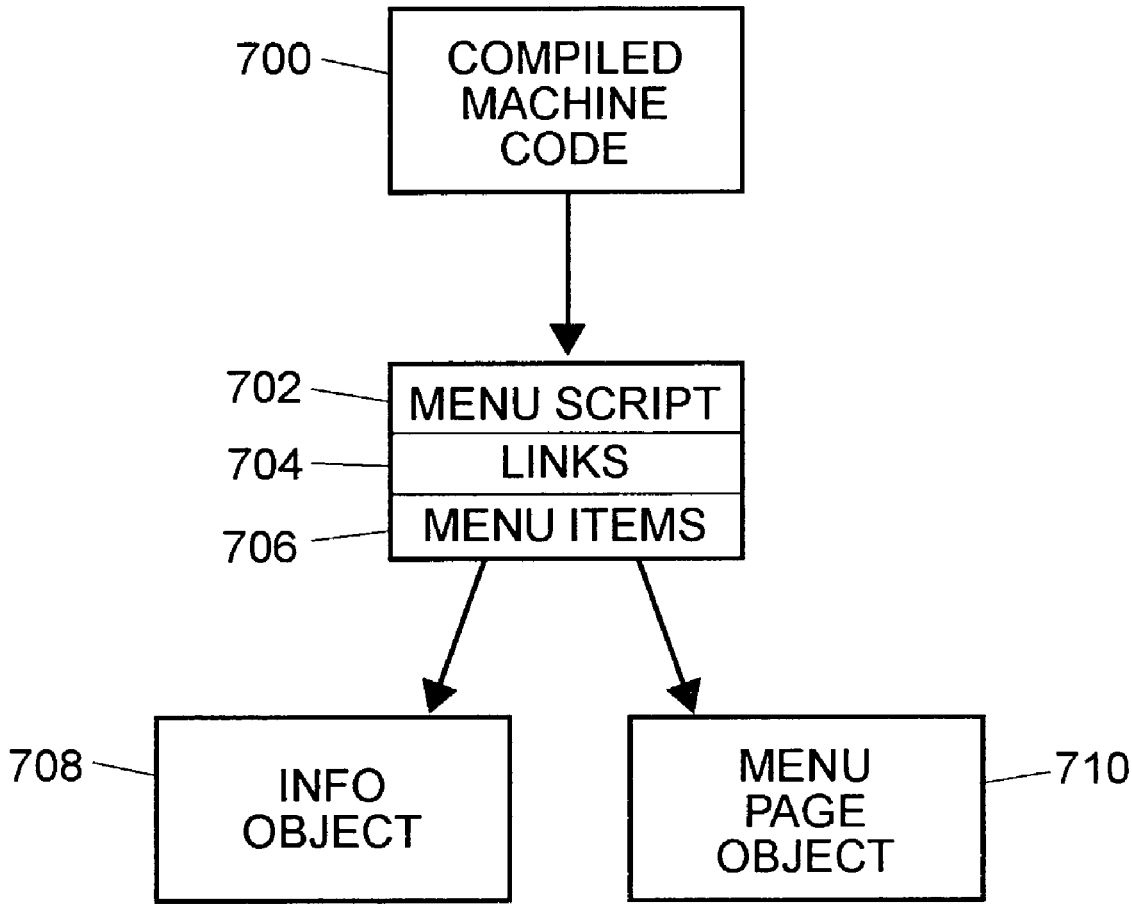
FIG. 16 is a diagram illustrating an example relationship between the various sources of menuing information in a gaming unit.

Turning now to FIG. 16, menu system software may be divided into compiled machine code 700, a menu script 702, which may include links 704 and menu items 706, and information and menu page objects 708, 710. The complied machine code 700 may be stored in the program memory 102 of the controller 100. As the controller 100 executes the compiled machine code 700, the compiled machine code 700 may point to the menu script 702, which may be a text-based file that is uncompiled and may be, for example, stored in the RAM 106 of the controller 100.

In general, the links, which 704 define the menu tree, or hierarchy, of the menu system, and the menu item 706 define the look and functionality of the menu items displayed in the hierarchy defined by the links 704. The menu items 706 may include references to the information objects 708 and the menu page objects 710. The details of each of the menu script 702, the information objects 708 and the menu page objects 710 are provided in conjunction with FIGS. 17-19.

Turning now to FIG. 17, an example menu script 720 may be defined by a menu header 722, which specifies that information following the menu header 722 is to be used for creating a menu. Within the menu header 722 may be two sections, one of which is a menu items section 724 and one of which is a links section 726. The menu items section 724 is defined by an items header 728, which indicates that the information following the items header 728 may be used to create menu items that will be displayed on the display 70 of the gaming unit 20. The links section 726 is defined by a links header 730, which indicates that the following information will tie the menu items defined after the items header 728 into a menu structure commonly referred to as a menu tree.

Referring now in detail to the menu item section 724, a number of menu items 732A-732L (generally, 732) are each defined by a number of properties shown within parentheses. For example, the menu item 732A, may include a reference name 734 of "MainAccounting," which defines the unique name used to refer to this menu item within the menu script 720. The menu item 732A may further include a display name 736 of "Accounting," which is the name that will be appear when the menu item 732A is displayed on the display 70 of the gaming unit 20.

The menu item 732A may also include an enabled field 738, which indicates whether the menu item 732A will be displayed to the user on the display 70. For example, if the enabled field 738 includes the text "enable," the menu item 732A will be viewable. Alternatively, if the enabled field 738 includes the text "disabled," the menu item 732A will not be viewable by the user.

The menu item 732A may also include an information field 740 and a page field 742, each of which may have text therein or may be blank. Any text provided in the information field 740 is the file name of an information object that is available for use with the menu item 732A. Information objects may, for example, be used to control how the menu item 732A is displayed. The page field 742 may include text therein specifying the name of a page to be displayed when the menu item 732A is selected. If the page field 742 is left blank, no page is to be displayed and selection of the menu item 732A merely links to a submenu.

A security field 744 of the menu item 732A may specify a required security clearance needed to view the menu item 732A on the display 70. For example, referring back to FIG. 4, if the security clearance obtained by the controller 100 (block 204) is not at least the rank of "Attendant" the menu item 732A will not be displayed on the display 70 of the gaming unit 20. The security field 744 may take various values that define the security requirement needed to view a particular menu item (e.g., the menu item 732A). For example, there may be five security requirement levels "in-game," "attendant," "operator," "Ekey" and "machine," which are listed in order of increasing security settings.

The in-game security requirement may allow menu items to be viewed while a game is in progress and, therefore, may allow access to a few diagnostic and version information pages. The attendant security requirement may allow menu items to be displayed when a reset switch of the gaming unit 20 has been actuated. The attendant security requirement may allow access to all the menu items the in-game security requirement allows and may also allow access to many menu items that display settings and perform diagnostic tests on the gaming unit 20. However, the attendant security requirement may not allow a user to change the settings that are viewed.

The operator security requirement may enable menu items to be displayed when a door of the gaming unit 20 is opened and a test switch is actuated. The operator security requirement may allow access to all the menus the in-game and attendant security requirements allow and may also allow access to menu items that may be changed, whereas the attendant security requirement may merely allow display of the menu items.

The Ekey security requirement may allow menu items to be displayed when a door of the gaming unit 20 is opened and a card cage door (not shown) of the gaming unit 20 is opened and an Ekey, which is a hardware security device, is plugged into a universal serial bus (USB) port of the gaming unit 20. The Ekey security requirement may allow access to high security menu items such as, for example, the ability to clear the memory of the gaming unit 20 or to change payoff settings of the gaming unit 20.

The machine security requirement may be used for menu items that will never be displayed, but are accessed by the gaming unit 20 only for some automatic feature. For example, turning a reset switch while in a menu may allow access to a machine menu option to calibrate a touch screen (not shown) that may be part of, or may overlie, the display 70. This allows the attendant to recalibrate the touch screen without having to use the touch screen to navigate menus.

Turning now to the links section 730 of the menu script 720, a sample menu structure is defined with reference to the menu items defined in the items section 724. A root menu header 750 indicates that the following information will define the root, or lowest level, of a menu tree. The menu structure is built by adding menu items 732 thereto. For example, link entries 752A-752D define that menu items 732A-732D having the reference names "MainAccounting," "MainDiagnostics," "MainEventLogs" and "MainSetup," which are defined in the menu item sections 724 of the menu script 720, are to be added to a menu as menu items in the root menu.

A main setup submenu header 754 defines menu items to be located under the MainSetup root menu item. For example, link entries 756A-756C indicate that menu items having the reference names "GameSetup", "CommSetup" and "MachineSetup" should be added under the MainSetup root menu item. A machine setup submenu header 758 defines menu items that may be located under the MachineSetup submenu found under the MainSetup root menu item, thereby defining the third level of menuing within the menu structure. Link entries 760A-760D define that menu items having the reference names "AttractSetup," "ClockSetup," "SitelDSetup" and "VolumeSetup" may be added as menu items under the MachineSetup submenu. A main diagnostic submenu header 762 defines a menu item "Reelstrip Test." Descriptions of the interface screens and menus generated by the menu script 720 are provided in conjunction with FIGS. 21-27.

While the foregoing description of FIG. 17 has outlined an example menu script and the various sections thereof, it will be readily appreciated by those having ordinary skill in the art that the disclosed menu script is merely an example and should not, therefore, be considered as limiting.

Returning briefly to FIG. 16, as noted previously, the menu script 702 may refer to information objects 708 and menu page objects 710 via menu items 706. As shown in FIG. 17, within the item section 724 of the menu script 720, menu item 732M defines a reel strip tests menu item including an information field having the text "info.so" therein, as shown at reference numeral 762. The text "info.so" is short for information (info) shared object (so), which points to a file bearing the name info.so that may include additional logic regarding display of the reel strip tests menu item 732M. For example, as shown in FIG. 18, a sample info.so file 770 indicates that if the game type is not equal to slots, then the reel strip test menu item 732M will be disabled. The interaction of the menu items 732 and the info.so file 770 is described in further detail in conjunction with FIGS. 20-27.

Referring again to the menu script 720, menu item 732L includes a page field defined to have the value "volume page.so" as shown at reference numeral 778. As noted previously, the page field of an item indicates a page that will be displayed when that item is selected. Accordingly, when the volume setup item 732L is selected, a volume page shared object will be displayed. Referring to FIG. 19, a sample volume page shared object 780 file is shown as including the entry "load volume page," wherein "volume page" is the name of a file specifying the appearance of a volume page.

While the general nature of the sample menu script 720 the info.so 770 and volume page.so 780 have been described, the interaction of these three items is illustrated below in conjunction with FIGS. 20-27.

Turning now to FIG. 20, the menu item processing routine 206 may cause the controller 100 to determine if menu items are to be processed (block 800). Menu items may be referred to as "to be processed" if they are to be displayed to the user. If no menu items are to be processed, the controller 100 will return to execution of the routine that called the menu item processing routine 206. For example, the controller 100 may return to executing the main routine 200 of FIG. 4 or to the main routine 300 of FIG. 5. Alternatively, if the controller 100 determines that there are menu items to be processed, the controller 100 will begin execution of a menu item display routine 802 and thereafter will execute a menu item selection routine 804. Further detail regarding each of the routines 802 and 804 is provided in conjunction with FIGS. 21 and 23, respectively.

Figure 21A:
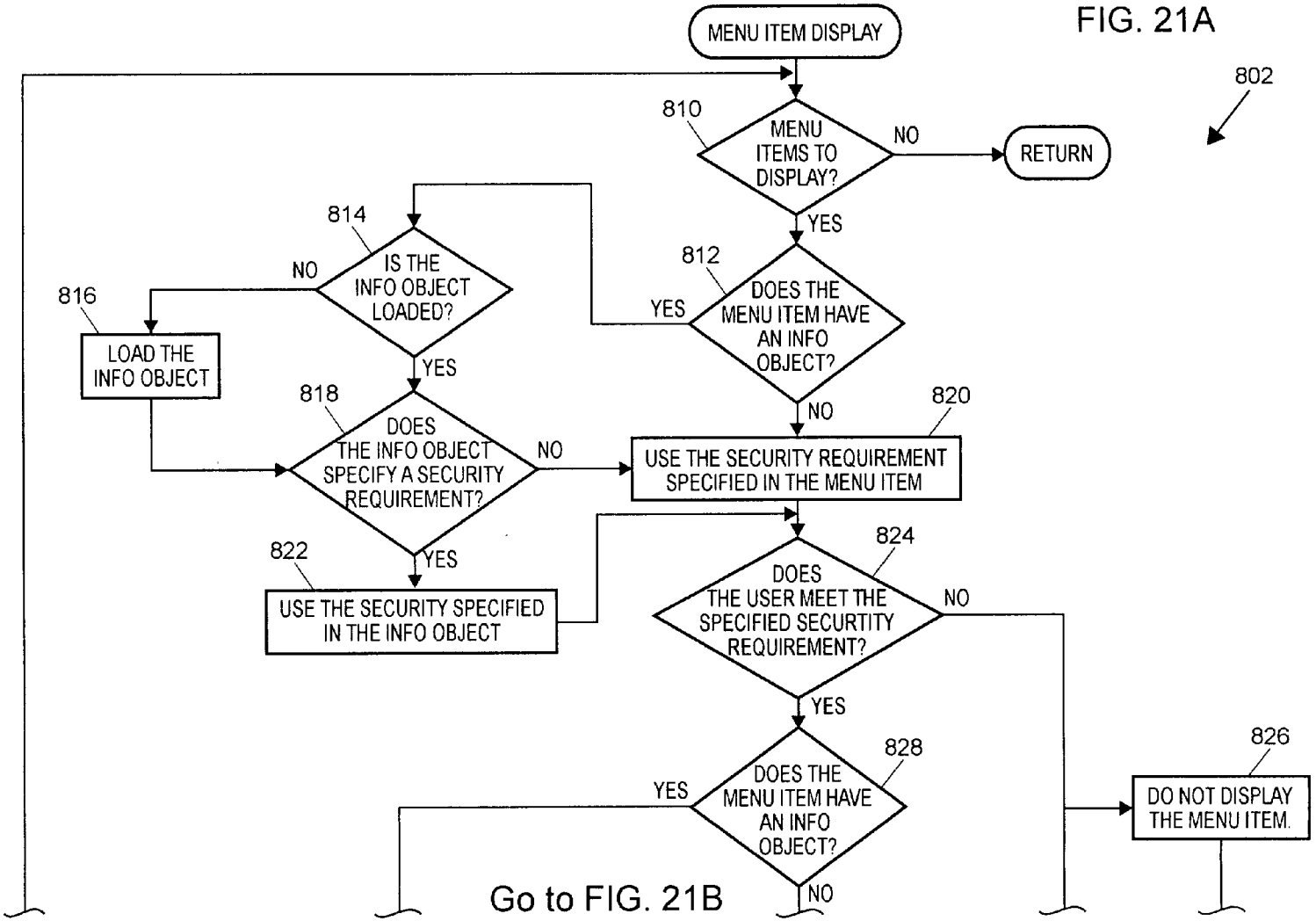
FIGS. 21A and 21B together form a flowchart of an embodiment of the menu item display routine of FIG. 20.
Figure 21B:
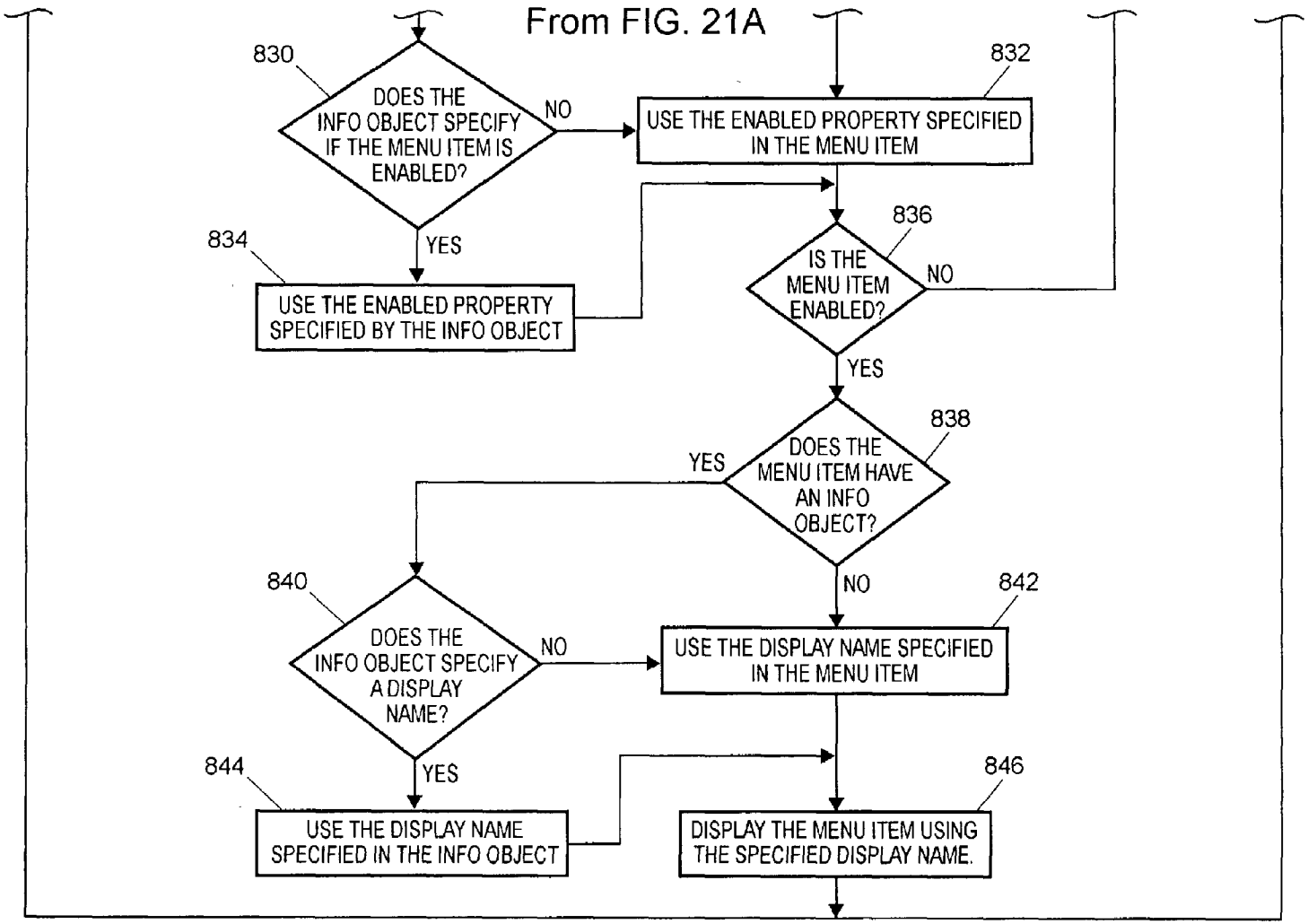

As shown in FIGS. 21A and 21B, collectively FIG. 21, the controller 100 begins execution of the menu item display routine 802 by determining if there are menu items to display (block 810). If there are no menu items to display, the controller 100 returns to executing the menu item processing routine 206 (FIG. 20) of the menu item selection routine 804. Menu items may be displayed in a one-at-a-time fashion, which means that the routine 802 may need to operate a number of times to generate, for example, the root menu, wherein each operation of the routine 802 adds one menu item to the display. Accordingly, if the controller 100 determines that there are menu items to display, the controller 100 determines if the menu item to be displayed has an associated information object (block 812) (i.e., if there is text provided in the information field of the menu item 732 specified in the menu script 720).

If the controller 100 determines that there is an associated information object for the menu item to be displayed, the controller 100 determines if the information object has been loaded into memory (block 814). If the information object has not been loaded, the controller 100 loads the information object (block 816) and determines if the information object specifies a security requirement (block 818). If either the controller 100 determines that the information object does not specify a security requirement or if the controller 100 determines that the menu item does not have an associated information object, the controller 100 uses the security requirement specified in the menu item (block 820). Alternatively, if the information object specifies a security requirement, the security requirement specified by the information object is used (block 822).

For example, returning to FIG. 17 for illustrative purposes, if the root menu is being displayed the first item to display is the MainAccounting item, which does not specify an information object in the information field 740. Accordingly, the security field 744, which is specified as "attendant" will be used for the balance of the execution of the menu item display routine 802.

Returning to FIG. 21, after the security requirement to be used is determined, the controller 100 determines if the user meets the specified security requirement (block 824). A determination regarding whether the user meets the specified security requirement may be carried out by comparing the information obtained at the block 204 of FIG. 4 with the security requirement to be used during the execution of the routine 802. If the controller 100 determines that the user does not meet the specified security requirement, the menu item will not be displayed (block 826) and the controller 100 will again determine if there are menu items to display (block 810).

Alternatively, if the controller 100 determines that the user does meet the specified security requirement, the controller 100 determines if the menu item has an associated information object (block 828). If the menu item does have an associated information object, the controller 100 determines if the information object specifies a menu item enabled property (block 830). If the information object does not specify an enabled property for the menu item, the controller 100 uses the enabled property specified in the menu item (block 832). Alternatively, if the controller 100 determines that the information object does specify an enabled property for the menu item, the controller 100 uses the enabled property specified in the information object (block 834).

After the enabled property either from the information object or the menu item is selected (blocks 832, 834), the controller 100 determines if the menu item is enabled by examining the selected enabled property (block 836). If the controller,100 determines that the menu item is not enabled (block 836), the menu item is not displayed (block 826) and the controller 100 returns to determine if there are more menu items to display (block 810).

Alternatively, if the controller 100 determines that the menu item is enabled (block 836), the controller 100 will then determine if the menu item has an associated information object (block 838) and, if so, the controller 100 determines if the information object specifies a display name (block 840). If a display name is not specified by the information object, the controller 100 uses the display name specified in the menu item (block 842). Alternatively, if the menu item does not have an associated information object, the controller 100 will also use the display name specified in the menu item (block 842). For example, returning to FIG. 17, menu item 732A includes a display name 736 of "Accounting" and does not specify an associated information object in the information field 740. Accordingly, when the MainAccounting menu item 732A is displayed, the display name 736 of "Accounting" will be used as a label for the item.

Alternatively, if the information object does specify a display name (block 840), the controller 100 will use the display name specified in the information object (block 844). After determining the display name to be used to display a menu item, the controller 100 displays the menu item using the specified display name (block 846) and then returns to determine if there are menu items to display (block 810).

Figure 22:
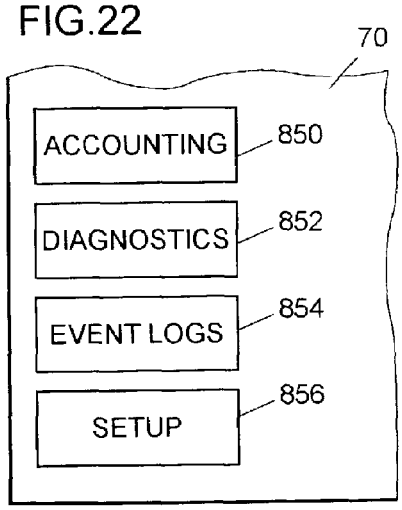
FIG. 22 is an illustration of an embodiment of a first menu level that may be displayed during performance of the menu item processing routine of FIG. 20.

As an example of the menu item display routine 802 in operation, FIG. 22 shows a portion of the display 70 including menu items entitled accounting, diagnostics, event logs and setup 850-856, respectively. The display of FIG. 22 would be generated as the root menu display that is specified in the link section 726 of FIG. 17. In particular, each of the MainAccounting, MainDiagnostics, MainEventLogs, and MainSetup link entries 752A-752D point to menu items 732A-732D.

As will be readily appreciated by reviewing FIG. 17, each of the menu items 732A-732D is enabled and does not include an information field 740 or a page field 742 having information specified therein. Accordingly the controller 100 executes the menu item display routine 802 by determining that there is a menu item to display (block 810), that the menu item does not have an information object (block 812) and using the attendant security requirement specified in menu item 732A (block 820). The controller 100 then determines that the user meets the attendant security requirement (block 824) and determines that the MainAccounting menu item 732A does not have an information object (block 828). The controller 100 then examines the enabled property of the MainAccounting 732A and determines that it is, in fact, enabled (block 832 and 836) and determines that the MainAccounting menu item does not have an associated information object 838 (block 838). The controller then displays the MainAccounting item 732A as display item 850 of FIG. 22 (842, 846). This process is repeated for each of the MainDiagnostics, MainEventLogs and MainSetup menu items that are specified as members of the root menu in the link section 726 thereby resulting in the display shown in FIG. 22.

Figure 23A:
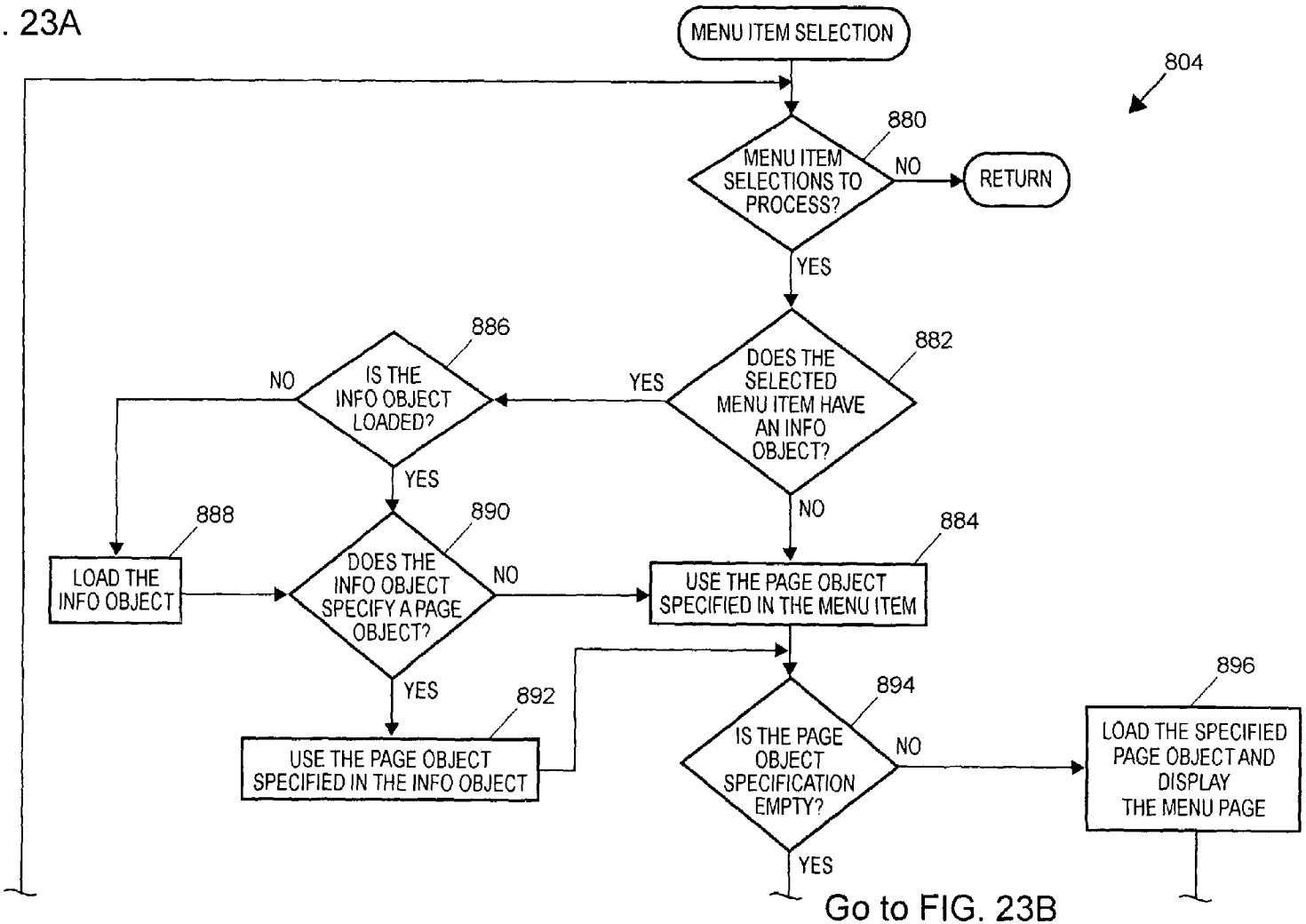
FIGS. 23A and 23B together form a flowchart of an embodiment of the menu item selection routine of FIG. 20.
Figure 23B:
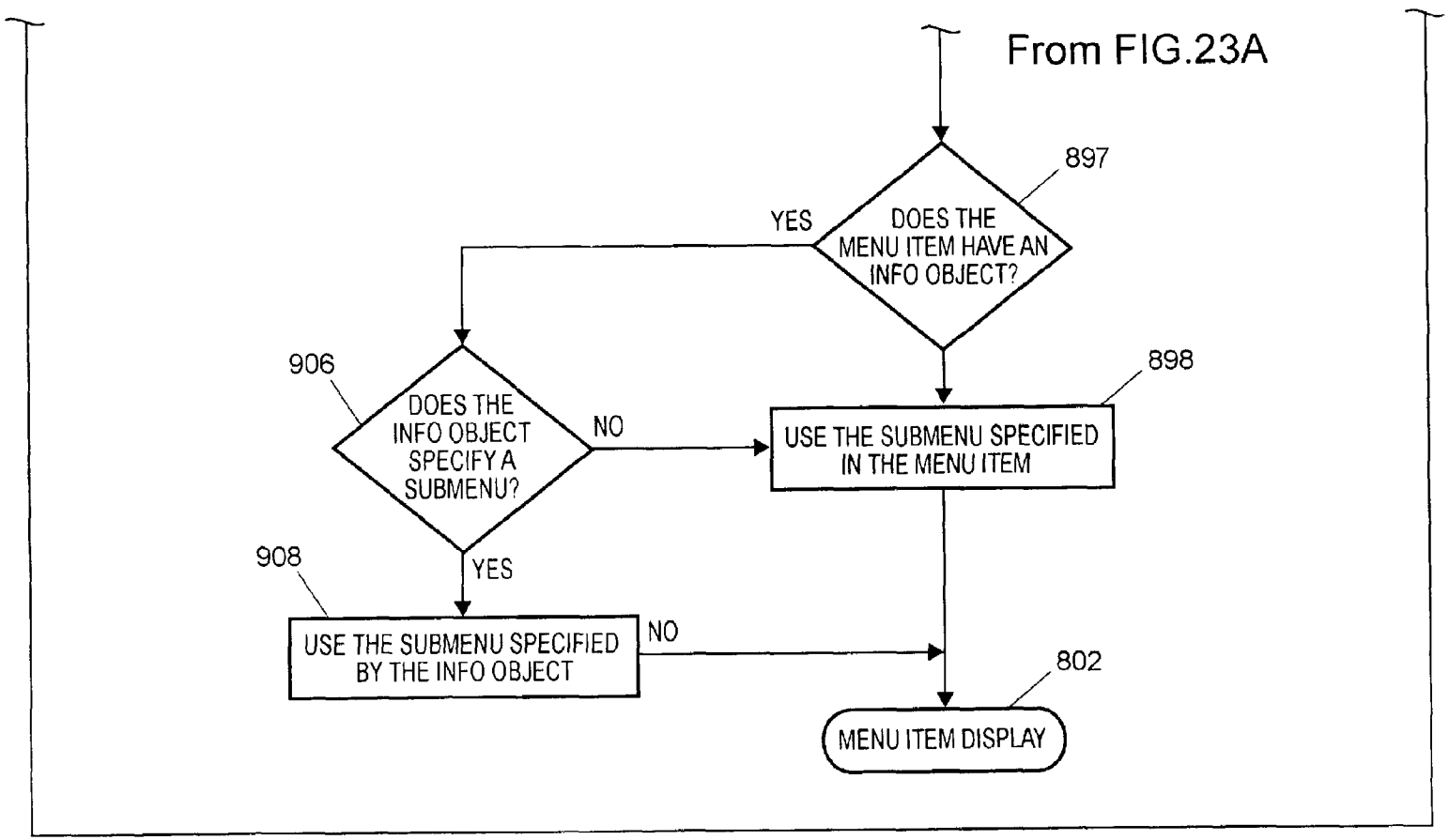

Turning now to FIGS. 23A and 23B, collectively FIG. 23, further detail of the menu item selection routine 804 is provided. The controller 100 begins execution of the routine 804 by determining if there are menu item selections to process (block 880). For example, if a touch screen is used as the display 70 and the root menu has been displayed as shown in FIG. 22, the controller 100 determines if one of the items 850-856 has been selected (block 880). If the controller 100 determines that no selection has been made, the controller 100 returns to executing the routine that called the menu item selection routine 804. Alternatively, if the controller 100 determines that a menu item selection has taken place (block 880), the controller 100 then determines if the selected menu item has an information object (block 882). For example, if the setup menu item 856 of FIG. 24 has been selected, the routine 804 will examine the MainSetup item 732D to determine if a file is specified in the information field 740. If the controller 100 determines that the menu item does not have an associated information object (block 882), the controller 100 uses the page object specified in the MainSetup item 732D (block 884).

Alternatively, if the controller 100 determines that the menu item does have an information object (block 882), the controller 100 then determines if the information object has been loaded (block 886), loads the information object if it has not been previously loaded (block 888) and then determines if the information object specifies a page object (block 890). If the loaded information object does not specify a page object (block 8.90), the controller 100 again uses the page object specified in the menu item (block 884). Alternatively, if the controller 100 determines that the information object does specify a page object (block 890), the controller uses the page object specified in the information object (block 892).

After selecting the page object to be used in connection with the menu item, the controller 100 determines if the page object specification is empty (block 894). If the page object specification is empty, the controller 100 loads the specified page object and displays the menu page (block 896) and returns to determine if there are menu items selections to process (block 880).

If, however, the controller 100 determines that the page object specification is empty (block 894), the controller then determines if the menu item has an associated information object (block 897). If, as is the case in the sample menu script 720 of FIG. 17, the menu item does not have an information object, the controller uses the submenu specified in the menu item (block 898). For example, considering the setup menu item 856 of FIG. 22, selection of the setup item 856 causes the controller to determine that no information object is specified for the setup menu item 856 and therefore determines what submenus are associated with the main setup menu item by checking the main setup submenu header 854 of the link section 726 of the sample menu script 720. Upon examining the sample menu script 720, the controller 100 determines that actuation of the setup item 856 generates a submenu including menu items referred to as GameSetup, ComSetup and MachineSetup, which in turn, refer to menu items 732F-732H (FIG. 17). The controller 100, then sensing that there is additional information to be displayed calls the menu item display routine 802, which was described in conjunction with FIG. 21 causes the display 70 to display three additional items 900-904 entitled GameOptions, ComConfig and MachineOptions as shown in FIG. 24.

Returning to FIG. 23, if the controller 100 determines that the menu item does have an associated information object (block 897), the controller 100 then determines if the information object specifies a submenu (block 906). If no submenu is specified in the information object, the controller 100 again uses the submenu specified in the menu item (block 898). Alternatively, if the information object does specify a submenu (block 906), the controller then uses the submenu specified in the information object (block 908) and then executes the menu item display routine 802.

Figure 24:
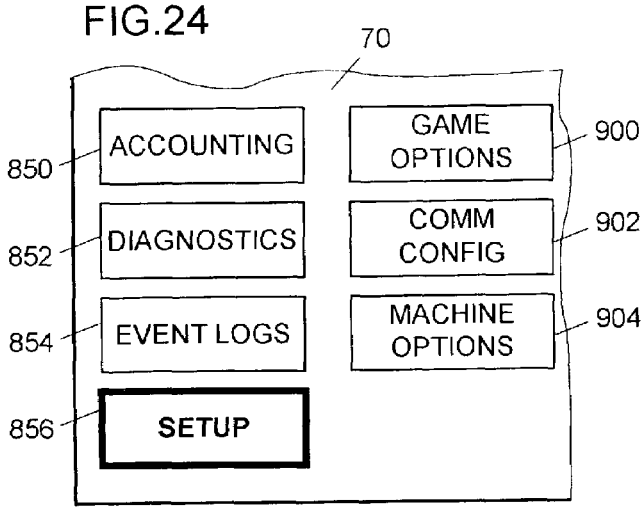
FIG. 24 is an illustration of an embodiment of a menu that may result for the selection of the setup menu item of FIG. 22.
Figure 25:
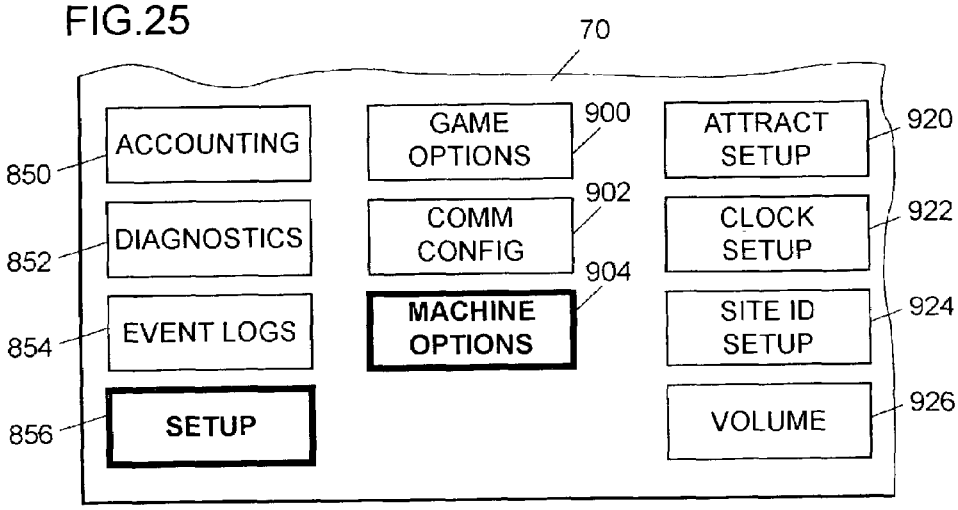
FIG. 25 is an illustration of an embodiment of a menu that may result from the selection of the machine options menu item of FIG. 24.
Figure 26:
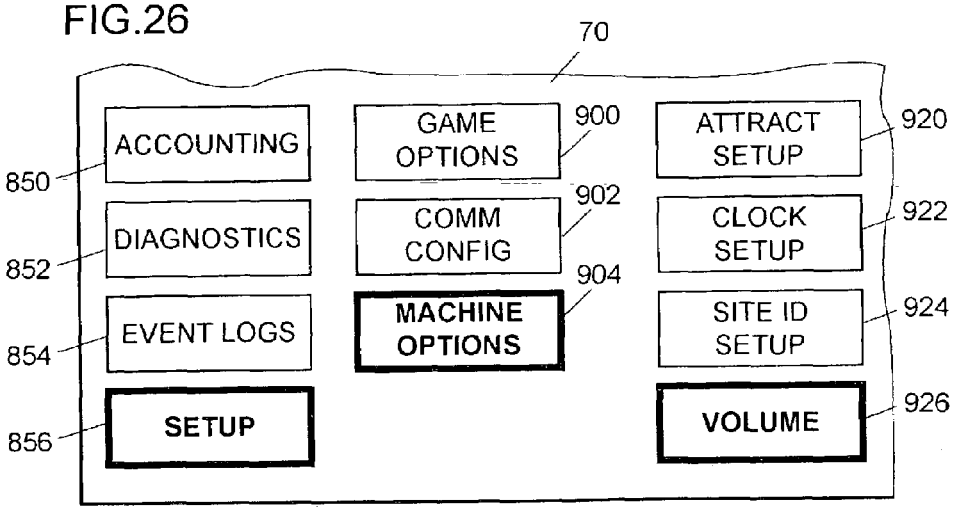
FIG. 26 is an illustration of an embodiment of a menu that may result from the selection of the volume menu item of FIG. 25.

The execution of the menu item selection routine 804 and the menu item display routine 802 will continue as a user continues to make selections from submenus shown in FIGS. 24-26. For example, as shown in FIG. 24, selection of the setup menu item 856 causes generation of menu items 900-904. Furthermore, selection of the machine options menu item 904 causes generation of a submenu including a TrackSetup, ClockSetup, SiteIDSetup and Volume menu items 920-926, as shown in FIG. 25.

Finally, the selection of the menu item 926 causes the controller 100 to execute the routine 804 to examine the volume setup item 732L as shown in the menu script 720 of FIG. 17. This causes the controller 100 to determine that a VolumePage.so 778 is specified (block 894) and causes the controller 100 to load the VolumePage.so and to display the specified menu page 896. This causes the controller 100 to load a volume page as specified in FIG. 19 referred to by reference numeral 780. Upon loading the volume page, the user may be presented with a display screen 70 appearing similar to the display screen 70 of FIG. 27.

Figure 27:
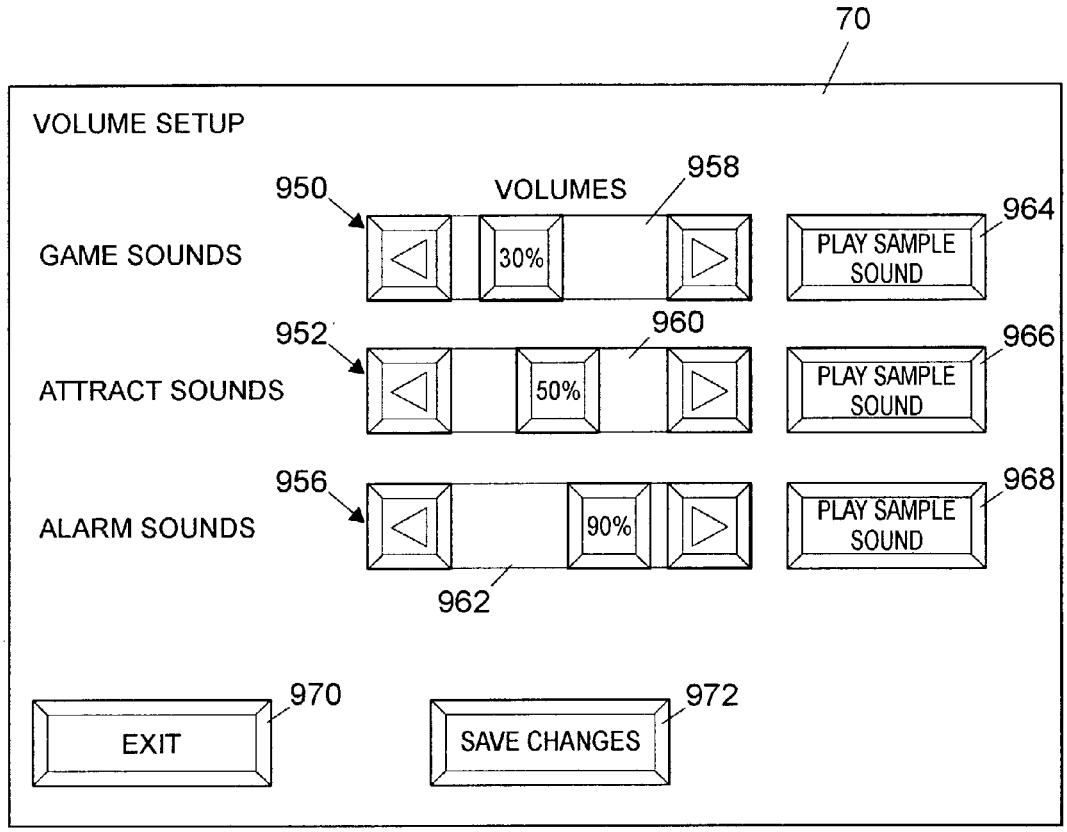
FIG. 27 is an illustration of an embodiment of a volume setup page that may be displayed upon the selection of the volume menu item of FIG. 26.

As shown in FIG. 27, the volume setup page includes controls for game sounds 950, track sounds 952 and alarm sounds 956. The menu controls may include sliding bars 958-962 associated with each of the sounds. Additionally, a number of play sample sound buttons may be provided 964-968, which allow a user to play sample sound from the gaming machine 20 once one of the volume bars 958-962 has been adjusted. The volume setup page may also include exit and save changes buttons 970, 972 that allow a user to exit the volume setup without making changes (button 970) or to save the changes made to the volumes for game sounds, track sounds and alarm sounds (button 972).

What is claimed is:

1. A gaming unit, comprising:

a controller;

memory;

a first display unit;

at least one input device;

at least one interface for communicating with at least one other device in a gaming network;

the gaming unit being operable to:

store, in the memory, a first portion of compiled, executable code and a first uncompiled data file;

control a wager-based game played at the gaming unit;

receive, via the at least one input device, a first portion of security information;

determine or identify, using the first portion of security information, a first menu item display security clearance parameter specifying at least one condition or criteria relating to a display of a first menu item;

determine, using the first portion of security information, whether the first menu item is permitted to be displayed at the first display unit;

permit a first portion of content relating to the first menu item to be displayed at the first display unit in response to a determination that the at least one condition or criteria of the first menu item display security clearance parameter is satisfied;

generate the first portion of content using information from the first uncompiled data file which includes a first uncompiled menu script specifying characteristics of the first menu item, wherein generating the first portion of content includes executing the first portion of compiled, executable code and processing the first uncompiled menu script;

display the first portion of content relating to the first menu item at the first display unit; and enable modification of the at least one characteristic of the first menu item without modifying the first portion of compiled, executable code.

2. The gaming unit of claim 1 being further operable to:

prevent the first portion of content relating to the first menu item from being displayed at the first display unit in response to a determination that the at least one condition or criteria of the first menu item display security clearance parameter is not satisfied.

3. The gaming unit of claim 1 being further operable to:

determine or identify a second portion of security information, the second portion of security information including a user security clearance parameter relating to a user of the gaming unit;

determine, using the first and second portions of security information, whether the first menu item is permitted to be displayed at the first display unit;

permit a first portion of content relating to the first menu item to be displayed at the first display unit in response to a determination that the user security clearance parameter satisfies the at least one condition or criteria of the first menu item display security clearance parameter;

prevent the first portion of content relating to the first menu item from being displayed at the first display unit in response to a determination that the user security clearance parameter does not satisfy the at least one condition or criteria of the first menu item display security clearance parameter.

4. The gaming unit of claim 1 being further operable to:

determine a value payout associated with an outcome of the wager-based game played at the gaming unit.

5. The gaming unit of claim 1 further comprising at least one value input device wherein the at least one value input device includes an input mechanism for receiving cash or an indicia of credit.

6. The gaming unit of claim 1 further comprising at least one value input device wherein the at least one value input device includes at least one of a coin acceptor, a bill acceptor, a card reader, and a ticket reader.

7. The gaming unit of claim 1:

the controller being operable to cause a first portion of content representing a game to be generated on the first display unit, the first portion of content representing one of the following games: video poker, video blackjack, video slots, video keno or video bingo;

the first portion of content comprising an image of at least five playing cards if the wager-based game comprises video poker;

the first portion of content comprising an image of a plurality of simulated slot machine reels of the wager-based game comprises video slots;

the first portion of content comprising an image of a plurality of playing cards if the wager-based game comprises video blackjack;

the first portion of content comprising an image of a plurality of keno numbers if the wager-based game comprises video keno;

the first portion of content comprising an image of a bingo grid if the wager-based game comprises video bingo, and the controller being operable to determine a value payout associated with an outcome of the wager-based game played at the gaming unit.

8. A gaming unit as defined in claim 1 wherein the controller is operable to define a menu tree structure using information from the first uncompiled menu script.

9. A gaming unit as defined in claim 1 wherein the controller is operable to define a name of the first menu item using information from the first uncompiled menu script.

10. A gaming unit as defined in claim 1 wherein the controller is operable to determine if the first menu item is enabled using information from the first uncompiled menu script.

11. A gaming unit as defined in claim 1, further comprising an interface configured for receiving security information from an Ekey.

12. A gaming unit as defined in claim 1, wherein the controller is operable to determine if the first menu item has an associated information file specified in the first uncompiled menu script.

13. A gaming unit as defined in claim 1, wherein the controller is operable to determine if the first menu item has an associated page file specified in the first uncompiled menu script.

14. A gaming unit, comprising:

a display unit that is capable of generating first portion of contents;

at least one value input device;

an interface configured for receiving security information from a hardware security device; and a controller operatively coupled to the first display unit and the at least one value input device, the controller comprising a processor and a memory operatively coupled to the processor;

the gaming unit being operable to:

determine a value payout associated with an outcome of a wager-based game, the gaming unit being further operable to:

store, in the memory, a first portion of compiled, executable code and a first text file;

determine or identify a first portion of the security information, the first portion of security information including a first menu item display security clearance parameter specifying at least one condition or criteria relating to a display of a first menu item;

determine, using the first portion of security information, whether the first menu item is permitted to be displayed at the first display unit;

permit a first portion of content relating to the first menu item to be displayed at the first display unit in response to a determination that the at least one condition or criteria of the first menu item display security clearance parameter is satisfied;

generate the first portion of content using information from the first text file which includes a first uncompiled menu script specifying characteristics of the first menu item, wherein generating the first portion of content includes executing the first portion of compiled, executable code and processing the first uncompiled menu script;

display the first portion of content relating to the first menu item at the first display unit; and enable modification of the at least one characteristic of the first menu item without modifying the first portion of compiled, executable code.

15. A gaming unit as defined in claim 14, wherein the text file specifies a menu tree structure in which the first menu item is displayed.

16. A gaming unit as defined in claim 14, wherein the text file specifies a name of the first menu item.

17. A gaming unit as defined in claim 14, wherein the interface is configured for receiving security information from an Ekey.

18. A gaming unit as defined in claim 14, wherein the text file specifies an information file associated with the first menu item.

19. A gaming unit as defined in claim 14, wherein the text file specifies a page file associated with the first menu item.

20. A gaming system in a casino gaming network, comprising:

controller;

memory;

a first display;

an input device;

at least one interface for communicating with at least one other device in the gaming network;

the gaming system being operable to:

store, in the memory, a first portion of compiled, executable code and a first uncompiled data file;

control a wager-based game played on the gaming system;

receive, via the input device, a first portion of security information;

determine or identify, using the first portion of security information, first menu item display security clearance parameter specifying at least one condition or criteria relating to a display of a first menu item;

determine, using the first portion of security information, whether the first menu item is permitted to be displayed at the first display unit;

permit a first portion of content relating to the first menu item to be displayed at the first display unit in response to a determination that the at least one condition or criteria of the first menu item display security clearance parameter is satisfied;

generate the first portion of content using information from the first uncompiled data file which includes a first uncompiled menu script specifying characteristics of the first menu item, wherein generating the first portion of content includes executing the first portion of compiled, executable code and processing the first uncompiled menu script;

display the first portion of content relating to the first menu item at the first display unit; and enable modification of the at least one characteristic of the first menu item without modifying the first portion of compiled, executable code.

21. The gaming system of claim 20 further comprising an input mechanism for receiving cash or an indicia of credit.

22. The gaming system of claim 20 wherein the first data file includes a third portion of uncompiled script comprising menu tree structure data, the gaming system being further operable to:

define a first menu tree structure using the menu tree structure data.

23. The gaming system of claim 20 wherein the first data file includes a third portion of uncompiled script comprising first menu item name data, the gaming system being further operable to:

define a name of the first menu item using the first menu item name data.

24. The gaming system of claim 20 wherein the first data file includes a third portion of uncompiled script comprising first menu item enablement data, the gaming system being further operable to:

determine whether access to the first menu item is enabled using the first menu item enablement data.

25. The gaming system of claim 20 wherein the first data file includes a third portion of uncompiled script comprising menu tree structure data, the gaming system being further operable to:

define a menu tree structure relating to the first menu item using the menu tree structure data; and enable modification of the menu tree structure without modifying compiled, executable code stored in the memory of the gaming system.

26. A method for facilitating play of a wager-based game on a gaming unit, the method comprising:

storing, in memory, a first portion of compiled, executable code and a first uncompiled data file;

controlling a wager-based game played at the gaming unit;

receiving a first portion of security information;

determining or identify, using the first portion of security information, a first menu item display security clearance parameter specifying at least one condition or criteria relating to a display of a first menu item;

determining, using the first portion of security information, whether the first menu item is permitted to be displayed at the first display unit;

permitting a first portion of content relating to the first menu item to be displayed at the first display unit in response to a determination that the at least one condition or criteria of the first menu item display security clearance parameter is satisfied;

generating the first portion of content using information from the first uncompiled data file which includes a first portion of uncompiled menu script specifying characteristics of the first menu item, wherein generating the first portion of content includes executing the first portion of compiled, executable code and processing the first uncompiled menu script;

displaying the first portion of content relating to the first menu item at the first display unit; and enabling modification of the at least one characteristic of the first menu item without modifying the first portion of compiled, executable code.

27. The method of claim 26 wherein the first uncompiled data file includes a third portion of uncompiled script comprising menu tree structure data, the method further comprising:

defining a first menu tree structure using the menu tree structure data.

28. The method of claim 26 wherein the first uncompiled data file includes a second portion of uncompiled script comprising first menu item name data, the method further comprising:

defining a name of the first menu item using the first menu item name data.

29. The method of claim 26 wherein the first uncompiled data file includes a second portion of uncompiled script comprising first menu item enablement data, the method further comprising:

determining whether access to the first menu item is enabled using the first menu item enablement data.

30. The method of claim 26 wherein the first uncompiled data file includes a second portion of uncompiled script comprising menu tree structure data, the method further comprising:

defining a menu tree structure relating to the first menu item using the menu tree structure data; and enabling modification of the menu tree structure without modifying compiled, executable code stored in the memory of the method.

31. A gaming system in a casino gaming network, comprising:

a controller;

memory;

a first display;

means for storing, in the memory, a first portion of compiled, executable code and a first uncompiled data file;

means for controlling a wager-based game played at the gaming unit;

means for receiving security information from a hardware security device;

means for determining or identifying a first portion of the security information, the first portion of security information including a first menu item display security clearance parameter specifying at least one condition or criteria relating to a display of a first menu item;

means for determining, using the first portion of security information, whether the first menu item is permitted to be displayed at the first display unit;

means for permitting a first portion of content relating to the first menu item to be displayed at the first display unit in response to a determination that the at least one condition or criteria of the first menu item display security clearance parameter is satisfied;

means for generating the first portion of content using information from the first uncompiled data file which includes a first uncompiled menu script specifying characteristics of the first menu item, wherein generating the first portion of content includes executing the first portion of compiled, executable code and processing the first uncompiled menu script; and means for displaying the first portion of content relating to the first menu item at the first display unit; and means for enabling modification of the at least one characteristic of the first menu item without modifying the first portion of compiled, executable code.

* * * * *

UNITED STATES PATENT AND TRADEMARK OFFICE

CERTIFICATE OF CORRECTION

PATENT NO. : 7,611,405 B2
APPLICATION NO. : 10/270766
DATED : November 3, 2009
INVENTOR(S) : Wolf et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 829 days.

Signed and Sealed this

Twelfth Day of October, 2010

David J. Kappos

David J. Kappos
*Director of the United States Patent and Trademark Office*